US009315045B2

(12) United States Patent
Kondo et al.

(10) Patent No.: US 9,315,045 B2
(45) Date of Patent: Apr. 19, 2016

(54) IMAGE FORMING APPARATUS CONFIGURED FOR ROLLED PRINTING

(71) Applicants: Kazuyoshi Kondo, Tokyo (JP); Kazuyoshi Matsumoto, Tokyo (JP); Makoto Kikura, Kanagawa (JP); Yuuzoh Obata, Tokyo (JP); Norikazu Yanase, Kanagawa (JP); Gaku Hosono, Kanagawa (JP); Satoru Yoshida, Kanagawa (JP); Masashi Ohnishi, Kanagawa (JP); Suguru Masunaga, Kanagawa (JP)

(72) Inventors: Kazuyoshi Kondo, Tokyo (JP); Kazuyoshi Matsumoto, Tokyo (JP); Makoto Kikura, Kanagawa (JP); Yuuzoh Obata, Tokyo (JP); Norikazu Yanase, Kanagawa (JP); Gaku Hosono, Kanagawa (JP); Satoru Yoshida, Kanagawa (JP); Masashi Ohnishi, Kanagawa (JP); Suguru Masunaga, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/462,719

(22) Filed: Aug. 19, 2014

(65) Prior Publication Data

US 2015/0054898 A1 Feb. 26, 2015

(30) Foreign Application Priority Data

Aug. 20, 2013 (JP) ..... 2013-170091

(51) Int. Cl.

| | |
|---|---|
| ***B41J 2/01*** | (2006.01) |
| ***B41J 3/407*** | (2006.01) |
| *B41J 2/005* | (2006.01) |

(52) U.S. Cl.

CPC ..... *B41J 3/4075* (2013.01); *B41J 2/0057* (2013.01); *B41J 2/01* (2013.01); *B41J 2002/012* (2013.01)

(58) Field of Classification Search

CPC .. B41J 3/4075; B41J 2002/012; B41J 2/0057; B41J 2/01; B41M 5/03

USPC ..... 347/104, 101, 16

See application file for complete search history.

(56) References Cited

U.S. PATENT DOCUMENTS 5,940,107 A * 8/1999 Fox ..... B41J 3/4075 101/288

2005/0018029 A1* 1/2005 Takagi ..... B41J 15/048 347/104

(Continued)

FOREIGN PATENT DOCUMENTS

| | | |
|---|---|---|
| JP | 8-059043 | 3/1996 |
| JP | 2001-158117 | 6/2001 |

(Continued)

OTHER PUBLICATIONS

U.S. Appl. No. 14/205,865, filed Mar. 12, 2014.

(Continued)

*Primary Examiner* — Henok Legesse

(74) *Attorney, Agent, or Firm* — Cooper & Dunham LLP

(57) ABSTRACT

An image forming apparatus includes a media roll, art image forming device, and a feeder. In the media roll, a printing medium having an adhesive face is wound in a roll shape. The image forming device forms an image on the printing medium. The feeder feeds the printing medium. The feeder includes a protection belt and a pair of rotary bodies. The protection belt presses against and protects the adhesive face of the printing medium. The pair of rotary bodies sandwich and press the printing medium and the protection belt between the pair of rotary bodies. An approach angle of the printing medium is within a range from 0° to 30° and is formed by the printing medium drawn from the media roll and approaching to between the pair of rotary bodies and an opposing face of the protection belt opposing the image forming device.

7 Claims, 31 Drawing Sheets

(56) References Cited

U.S. PATENT DOCUMENTS

| | | | | |
|---|---|---|---|---|
| 2007/0229641 | A1* | 10/2007 | Nakazawa | B41J 2/16585 347/104 |
| 2011/0063391 | A1 | 3/2011 | Miyamoto et al. | |
| 2014/0028752 | A1 | 1/2014 | Kikura et al. | |
| 2014/0029023 | A1 | 1/2014 | Yanase et al. | |
| 2014/0078232 | A1 | 3/2014 | Kondo et al. | |
| 2014/0079461 | A1 | 3/2014 | Obata et al. | |
| 2014/0099148 | A1 | 4/2014 | Obata et al. | |
| 2014/0099150 | A1 | 4/2014 | Matsumoto et al. | |
| 2014/0105661 | A1 | 4/2014 | Kondo et al. | |

FOREIGN PATENT DOCUMENTS

| | | |
|---|---|---|
| JP | 2003-252476 | 9/2003 |
| JP | 2007-301869 | 11/2007 |
| JP | 2011-062820 | 3/2011 |

OTHER PUBLICATIONS

U.S. Appl. No. 14/184,892, filed Feb. 20, 2014.

* cited by examiner

| APPROACH ANGLE α° | 120 | 90 | 60 | 45 | 35 | 30 | 25 | 10 | 0 |
|---|---|---|---|---|---|---|---|---|---|
| OCCURRENCE OF COCKLING | YES | YES | YES | YES | YES | NO | NO | NO | NO |

FIG. 21

| TYPE OF LABEL | POSITION OF RELAY ROLLER | VIA RELAY ROLLER | EFFECT |
|---|---|---|---|
| LABEL WITH LINER | C | YES | DECURL |
| | | NO | PREVENTION OF CONTACT OF PRINTING FACE WITH RELAY ROLLER |
| LINERLESS LABEL | B | YES | PREVENTION OF OCCURRENCE OF COCKLING |
| | | NO | PREVENTION OF CONTACT OF ADHESIVE FACE WITH RELAY ROLLER |
| BACK-FACE PRINTING LABEL (TRANSPARENT LABEL) | C | NO | PREVENTION OF CONTACT OF PRINTING FACE (ADHESIVE FACE) WITH RELAY ROLLER |

IMAGE FORMING APPARATUS CONFIGURED FOR ROLLED PRINTING MEDIA HAVING ADHESIVE FACE

CROSS-REFERENCE TO RELATED APPLICATIONS

This patent application is based on and claims priority pursuant to 35 U.S.C. §119(a) to Japanese Patent Application No. 2013-170091, filed on Aug. 20, 2013, in the Japan Patent Office, the entire disclosure of which is hereby incorporated by reference herein.

BACKGROUND

1. Technical Field

Embodiments of this disclosure relate to an image forming apparatus, and more specifically to an image forming apparatus using a rolled printing medium.

2. Description of the Related Art

Image forming apparatuses are used as printers, facsimile machines, copiers, plotters, or multi-functional devices having, e.g., two or more of the foregoing capabilities. As one type of image forming apparatuses, for example, an image forming apparatus, such as a label printer, is known that prints a rolled printing medium having an adhesive face on which a separation sheet is attached (hereinafter, also referred to as "linerless label sheet"), such as a label sheet having no tape or mount sheet, and cuts the printing medium to a desired length after printing to form a printing medium piece (hereinafter, "label piece).

When such an image forming apparatus feeds a printing medium, such as a linerless label sheet, with the adhesive face exposed to between rotary bodies, the adhesive face may adhere to the rotary bodies and hardly slide over the rotary bodies. As a result, as the printing medium is fed toward the rotary bodies, the printing medium is increasingly bent at the vicinity of a nipping portion of the rotary bodies. Further, when the printing medium passes between the rotary bodies, the printing medium may wrinkle.

BRIEF SUMMARY

In at least one embodiment of this disclosure, there is provided an image forming apparatus including a media roll, an image forming device, and a feeder. In the media roll, a printing medium having an adhesive face is wound in a roll shape. The image forming device forms an image on the printing medium. The feeder feeds the printing medium. The feeder includes a protection belt and a pair of rotary bodies. The protection belt presses against and protects the adhesive face of the printing medium. The pair of rotary bodies sandwich and press the printing medium and the protection belt between the pair of rotary bodies. An approach angle of the printing medium is within a range from 0° to 30° and is formed by the printing medium drawn from the media roll and approaching to between the pair of rotary bodies and an opposing face of the protection belt opposing the image forming device.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 21 is a table of an example of relation among label type (type of printing media), position of the relay roller, passing/bypassing of the relay roller, and effects.

FIG. 28 is a plan view of a relay-roller moving assembly in the ninth embodiment in a state in which the relay roller is pushed in;

Figure 1:
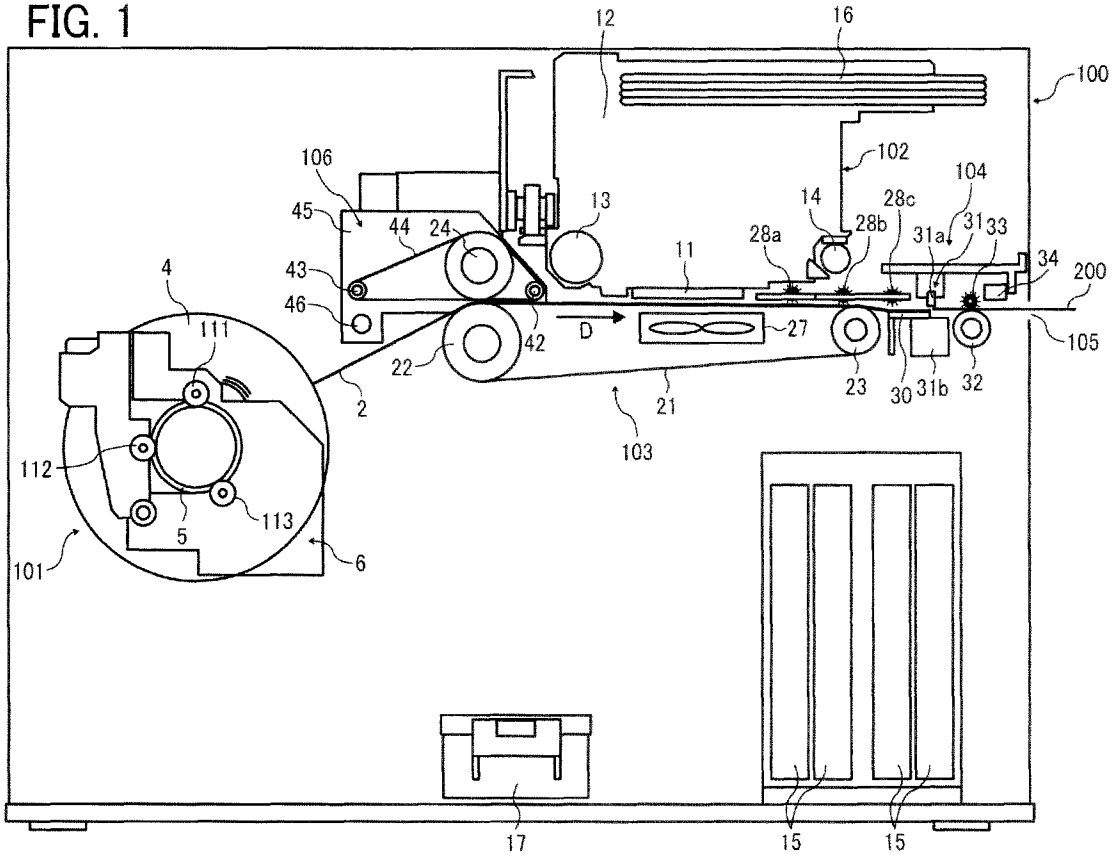
FIG. 1 is a front view of a configuration of a mechanical section of an image apparatus according to a first embodiment of this disclosure.

The accompanying drawings are intended to depict embodiments of the present disclosure and should not be interpreted to limit the scope thereof. The accompanying drawings are not to be considered as drawn to scale unless explicitly noted,

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "image formation" includes providing not only meaningful images, such as characters and figures, but meaningless images, such as patterns, to e (in other words, the term "image formation" also includes causing liquid droplets to land on printing media).

The term "ink" is not limited to "ink" in a narrow sense, unless specified, but is used as a generic term for any types of liquid usable as targets of image formation. For example, the term "ink" includes recording liquid, fixing solution, liquid, and so on.

The term "image forming apparatus", unless specified, also includes both serial-type image forming apparatus and line-type image forming apparatus.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

First, an image forming apparatus according to a first embodiment of this disclosure is described with reference to FIGS. 1 and 2.

FIG. 1 is a front view of a mechanical section of an image forming apparatus 100 according to the first embodiment of this disclosure. FIG. 2 is a partial side view of the mechanical section with a printing medium.

As illustrated in FIG. 1, the image forming apparatus 1000 has a sheet feeding unit 101 serving as a sheet feeder, an image forming unit 102 as an image forming device, a conveyance unit 103 as a conveyor, and a discharge conveyance unit 104 as a discharge conveyor within an apparatus body 100. The image forming apparatus 1000 also has a discharge port 105 and a guide unit 106. The discharge port 105 serves as a discharge port part to discharge a printing medium 2 having an image formed thereof to the outside of the apparatus body 100. The guide unit 106 guides a rolled printing medium 2 during conveyance and pull-back of the printing medium 2.

A media roll 4 formed of the rolled printing medium 2 is loaded on the sheet feeding unit 101.

Figure 2:
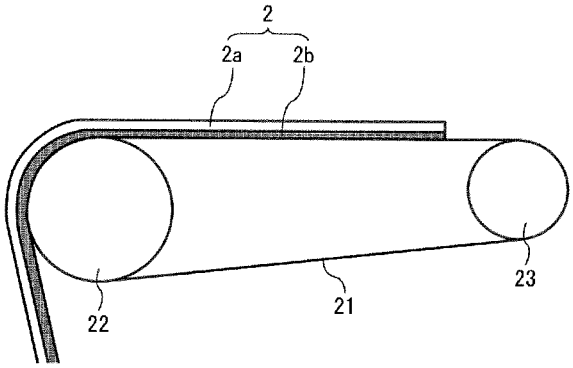
FIG. 2 is a partial side view of the mechanical section with a printing medium.

As illustrated in FIG. 2, the printing medium 2 is a continuum having an image-formable medium (hereinafter, also referred to as "printing face") 2*a* and an adhesive layer (hereinafter, referred to as "adhesive face") 2*b* formed on a surface of the image-formable medium 2*a*. The printing medium 2 is a linerless label sheet rolled around in a state in which a mount sheet (separation sheet or separator) is not adhered to the adhesive face 2*b*.

The media roll 4 is engaged with a spool 5. Each of opposed ends of the spool 5 is rotatably held at three points, i.e., by a first roller 111, a second roller 112, and a third roller 113 serving as a first rotary body, a second rotary body, and a third rotary body, respectively.

The term "spool" used herein is not limited to a member that is provided separately from a core member and engaged with the core member for use. The spool may be held by roll holder members 6 as an integral part of the core member of the media roll 4. In a case in which the core member of the media roll 4 is directly held, the term "spool" includes the core member.

The image forming unit 102 includes a recording head 11 and a carriage 12. The recording head 11 is a liquid ejection head mounted on the carriage 12 to eject droplets onto a printing medium 2. The carriage 12 is supported by guide members 13 and 14 so as to be reciprocally movable along a direction (main scanning direction) perpendicular to a conveyance direction of the printing medium 2 indicated by arrow D in FIG. 1.

For this embodiment, as the recording head 11, two recording heads 11 formed of liquid ejection heads each having two nozzle rows are used. The two recording heads 11 eject ink droplets of, for example, black (K), cyan (C), magenta (M), and yellow (Y) from four nozzle rows. It is to be noted that the configuration of the recording head is not limited to the above-described configuration but may be other type of recording head, for example, a line-type recording head.

Ink cartridges 15 storing respective color inks are mounted to the apparatus body 100 in a replaceable manner. The color inks are supplied from the ink cartridges 15 to via supply tubes 16 to head tanks mounted on the carriage 12, and further supplied from the head tanks to the recording heads 11.

The image forming apparatus 1000 also has a waste liquid tank 17 mounted to the apparatus body 100 in a replaceable manner. For example, in a maintenance operation for maintaining and recovering the performance of the recording heads 11, waste ink is discharged into and stored in the waste liquid tank 17.

The image forming unit 102 is not limited to the above-described liquid ejection head but may be any other type of image forming unit to form an image in a contact or non-contact manner.

The conveyance unit 103 includes a protection belt 21 as a protection member and a conveyance member. The protection belt 21 is arranged in an endless belt form below the recording heads 11. The protection belt 21 is looped around a conveyance roller 22 and a tensioned driven roller 23 so as to circulate.

The protection belt 21 preferably has no adhesion to the adhesive face 2*b*. However, to prevent the printing medium 21 from floating up from the protection belt 21 during conveyance, the protection belt 21 may have such low adhesion to the adhesive face 2*b* that the protection belt 21 is separatable from the adhesive face 2*b*.

Pressing the protection belt 21 against the adhesive face 2*b* allows protection of the adhesive face 2*b* and prevents the adhesive face 2*b* from contacting components inside the image forming apparatus to allow stable conveyance of the printing medium 2. In addition, since the protection belt 21 is separatable from the adhesive face 2*b*, the printing medium 2 separated from the protection belt 21 is discharged from the discharge port 105.

In other words, in this embodiment, the protection belt 21 protects the adhesive face 2*b* of the printing medium 2 and is transported together with the printing medium 2.

An opposing roller 24 is disposed opposing the conveyance roller 22. A conveyance roller pair (in this embodiment, pair of rotary bodies) of the conveyance roller 22 and the opposing roller 24 constitutes a conveyor to sandwich the printing medium 2 and the protection belt 21 together and convey the printing medium 2 to an image forming region of the recording heads 11.

The protection belt 21 has multiple holes. Within a loop formed by the protection belt 21, a suction fan 27 is disposed opposing the recording heads 11 of the image forming unit 102. The suction fan 27 sucks the printing medium 2 toward a surface of the protection belt 21 via the suction holes.

In the above-described configuration, the printing medium 2 is adhered onto the protection belt 21 by suction. It is to be noted that the force to adhere the printing medium to the protection belt is not limited to suction force but, for example, electrostatic force may be used to adhere the printing medium onto the protection belt. Alternatively, the adhesion of the adhesive face 2*b* of the printing medium 2 may be utilized to prevent the printing medium 2 from floating up from the protection belt 21.

In addition, spur roller units 28*a*, 28*b*, and 28*c* are disposed near the driven roller 23. Each of the spur roller units 28*a*, 28*b*, and 28*c* has multiple spur rollers arranged in the direction perpendicular to the conveyance direction D. The upstream spur roller units 28*a* and 28*b* are disposed opposing the protection belt 21, and the most downstream spur roller unit 28*c* is disposed opposing a receive member 30 of the discharge conveyance unit 104.

The receive member 30 guides the printing medium 2 fed from between the protection belt 21 and the spur roller unit 28*c*. The discharge conveyance unit 104 has a cutter unit 31 serving as a cutting device to cut a printing medium 2 into a desired length to form a printing medium piece (label piece) 200. The discharge conveyance unit 104 is disposed downstream from the receive member 30 in the conveyance direction D of the printing medium 2.

The cutter unit 31 includes a lower blade 31*b* and a cutting blade (upper blade or cutter) 31*a*. The lower blade 31*b* is formed at a downstream edge surface of the receive member 30. The cutter 31*a* cuts the printing medium 2 between the lower blade 31*b* and the cutter 31*a*. The cutter 31*a* is moved in the direction perpendicular to the conveyance direction D to cut the printing medium 2.

A discharge roller 32 is disposed downstream from the cutter unit 31 in the conveyance direction D. A spur roller 33 is disposed opposing the discharge roller 32. The discharge roller 32 and the spur roller 33 hold the label piece 200, which is cut by the cutter unit 31, in a state in which a leading end of the label piece 200 is sent out to the discharge port 105 serving as a discharge port part of the apparatus body 100.

In this embodiment, a surface of the discharge roller 32 to hold the label piece 200 is, for example, non-adherence processed (processed so that the adhesive surface 2*b* does not adhere to the surface of the discharge roller 32), thus allowing separation of the adhesive surface 2*b* of the label piece 200. In some embodiments, the discharge roller 32 itself may be made of a material allowing separation of the adhesive surface 2*b* of the label piece 200.

A sheet sensor 34 is disposed to detect presence of absence of a printing medium 2. The sheet sensor 34 is constituted of, for example, a photosensor or a combination of a mechanical lever and a photosensor.

The label piece 200 has the adhesive face at one side. Accordingly, if label pieces 200 are discharged to the outside of the apparatus body 100 after cutting, the label pieces 200 may adhere to each other, thus causing difficulty in handling. Hence, as described above, the discharge roller 32 and the spur roller 33 holds a label piece 200 after cutting. When the sheet sensor 34 detects that the label piece 200 has been pulled out, a subsequent label piece 200 is fed forward and held by the discharge roller 32 and the spur roller 33.

On a downstream side of the opposing roller 24 also serving as the first roller constituting the conveyance unit 103, the guide unit 106 has a second roller 42 serving as a separation roller disposed upstream from the image forming unit 102 and a third roller 43 disposed opposing the second roller 42 via the opposing roller 24. An endless guide belt 44 is looped around the opposing roller 24, the second roller 42, and the third roller 43.

The guide belt 44 is a belt member having a base member made of, e.g., polyimide and a release layer (e.g., silicone coating) as a surface layer to enhance the release performance of the guide belt 44.

The opposing roller 24, the second roller 42, and the third roller 43 are rotatably held by a holder member 45. The holder member 45 is rotatable around a shaft 46 and is displaceable between at a position at the opposing roller 24 opposes the conveyance roller 22 and a position at which the opposing roller 24 separates from the conveyance roller 22 to open a space between the opposing roller 24 and the conveyance roller 22.

When the media roll 4 is loaded and the printing medium 2 is set on the protection belt 21, the space between the opposing roller 24 and the conveyance roller 22 is opened. When the printing medium 2 is conveyed, the opposing roller 24 is pressed toward the conveyance roller 22. Accordingly, the opposing roller 24 is pressed toward the conveyance roller 22 by a pressing unit, such as a spring. In addition, the second roller 42 is pressed toward the protection belt 21 by a pressing unit, such as a spring.

For this embodiment, as described above, the adhesive face 2*b* of the printing medium 2 is set on the protection belt 21 for image formation. Alternatively, another configuration may be employed in which an image is formed on the adhesive face 2*b* of the printing medium 2. In such a configuration, non-adhesive processing is preferably performed on a surface of the guide belt 44.

For the image forming apparatus 1000 having such a configuration, the protection belt 21 and the printing medium 2 pulled out from the media roll 4 loaded on the sheet feeding unit 101 are sandwiched together between the conveyance roller 22 and the opposing roller 24.

When the conveyance roller 22 is rotated, the printing medium 2*b* and the protection belt 21 are conveyed together in a state in which the adhesive face 2*b* is protected by the protection belt 21. A desired image is formed on the printing medium 2 by the recording heads 11 of the image forming unit 102.

When the protection belt 21 is separated from the printing medium 2 having the image formed thereon, the printing medium 2 is conveyed to the discharge conveyance unit 104 and cut at a desired position by the cutter unit 31 to form a label piece 200. The label piece 200 is held between the discharge roller 32 and the spur rollers 33 in a state in which the label piece 200 is extractable from the discharge port 105 of the apparatus body 100.

The guide unit 106 also prevents the printing medium 2 from being reeled by the opposing roller 24 during conveyance and pull-back of the printing medium 2, in particular, when an image is formed on the adhesive face 2*b* of the printing medium 2.

In other words, even if the surface of the opposing roller 24 is processed for non-adhesion, the adhesive face 2*b* of the printing medium 2 might adhere to the circumferential surface of the opposing roller 24 and be reeled by the opposing roller 24 due to a small curvature of the opposing roller 24. In such a case, it is conceivable to use a larger curvature of the opposing roller 24. However, a larger curvature of the opposing roller 24 reduces the size of a nip area between the opposing roller 24 and the conveyance roller 22, thus preventing obtainment of stable conveyance force.

Hence, during conveyance, the printing medium 2 is conveyed while being pressed by the guide belt 44, and the guide belt 44 is reliably separated from the printing medium 2 by the second roller 42 serving as a separation roller having a large curvature, thus preventing the printing medium 2 from being reeled by the opposing roller 24 during conveyance.

When the printing medium 2 is pulled back, the guide belt 44 receives the adhesive face 2*b* of the printing medium 2, thus preventing the printing medium 2 from being reeled by the opposing roller 24.

When image formation is finished and the printing medium 2 is cut by the cutter unit 31, the leading end of the printing medium 2 is at the position of the cutter unit 31 and an area of the printing medium 2 opposite the image forming unit 102 is an unused area. In such a state, if the next image forming operation is resumed, the unused area of the printing medium 2 is wasted. Hence, in this embodiment, the printing medium 2 is pulled back in a pull-back direction (opposite the conveyance direction of the printing medium 2) to a position at which the leading end of the printing medium 2 is placed upstream from the image forming unit 102 in the conveyance direction.

Next, an approach angle of the printing medium 2 to the protection belt 21 (between the conveyance roller 22 and the opposing roller 24) in the image forming apparatus according to this embodiment is described with reference to FIGS. 3 and 4.

Figure 3:
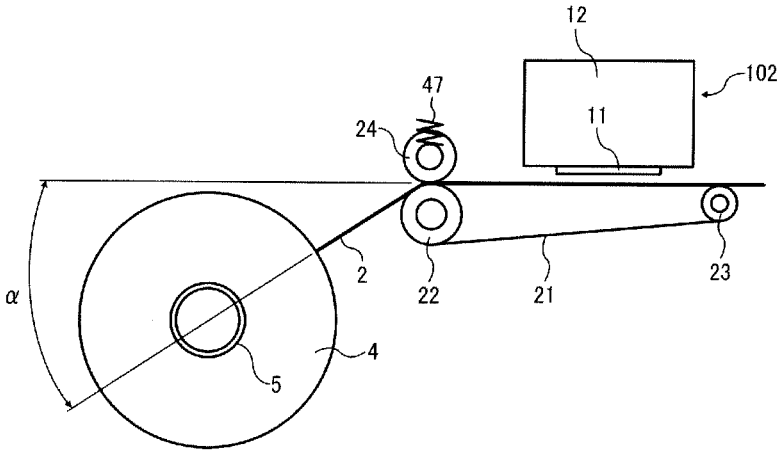
FIG. 3 is a partial front view of a sheet feed section and a sheet conveyance section of the mechanical section.

FIG. 3 is a partial front view of a region from sheet feeder to the conveyance unit in the image forming apparatus. FIG. 4 is an enlarged view of the conveyance roller 22 and a surrounding area thereof.

When the printing medium 2 is pulled from the media roll 4, the printing medium 2 is peeled off against adhesion of the adhesive face 2*b*. Accordingly, as illustrated in FIG. 3, the printing medium 2 is pulled out in a normal direction of the media roll 4.

Figure 4:
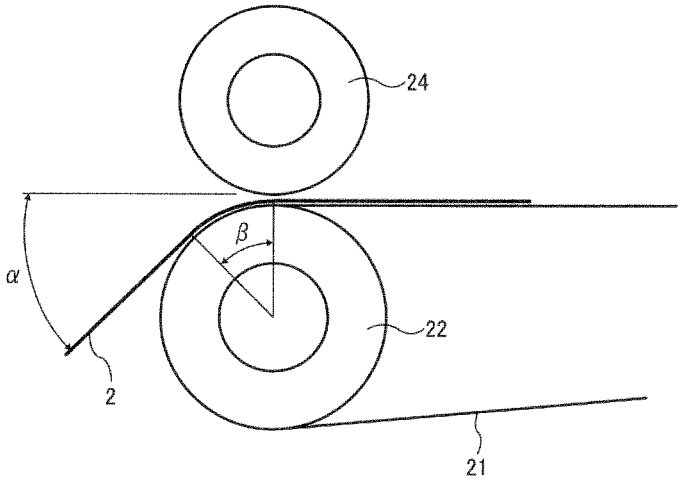
FIG. 4 is an enlarged view a conveyance roller and a surrounding area thereof in the image forming apparatus.

Here, as illustrated in FIGS. 3 and 4, the term "approach angle $\alpha$ of a printing medium" is an angle of the printing medium 2 pulled from the media roll 4 and approaching to between the conveyance roller 22 and the opposing roller 24 (i.e., between the paired rollers) relative to a face (hereinafter, support face) of the protection belt 21 facing the image forming unit 102. The opposing roller 24 is pressed toward the conveyance roller 22 by a spring 47. The approach angle $\alpha$ and an angle (winding angle) $\beta$ at which the printing medium 2 illustrated in FIG. 4 is wound around the circumferential surface of the conveyance roller 22 satisfy a relation of $\alpha=\beta$.

Next, occurrence of wrinkles in a printing medium comparative example is described with reference to FIGS. 5 and 6.

Figure 5:
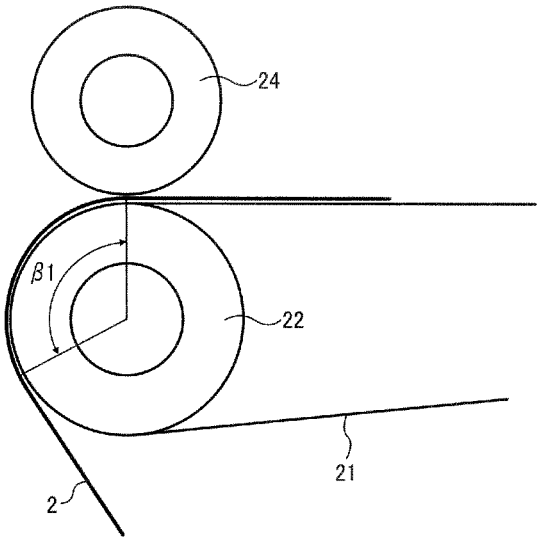
FIG. 5 is a partial front view of a conveyance roller and a surrounding area thereof in a comparative example.

FIG. 5 is a partial front view of a conveyance roller 22 and a surrounding area thereof in the comparative example. FIG. 6 is a partial front view of occurrence of wrinkles in the comparative example.

In this comparative example, a media roll is arranged so that a winding angle $\beta 1$ at which a printing medium 2 is wound around a circumferential surface of the conveyance roller 22 is greater than the winding angle $\beta$ of FIG. 4 in this embodiment ($\beta 1>\beta$).

Figures 6, 7:
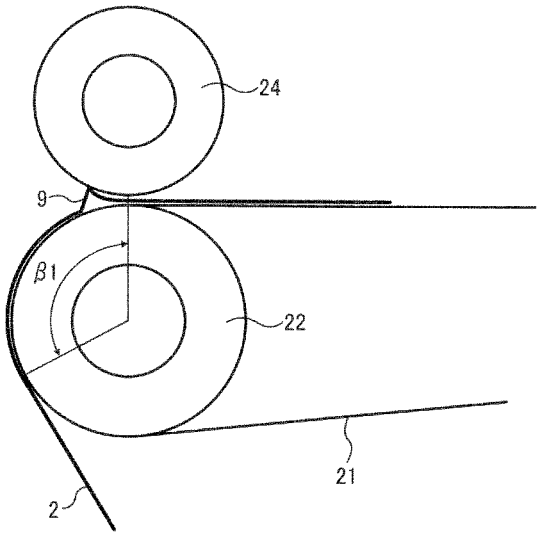
FIG. 6 is a partial front view of occurrence of wrinkles in the comparative example of FIG. 5.
FIG. 7 is a table of experiment results of approach angle $\alpha$ and occurrence of wrinkles.

In this comparative example, when the conveyance roller 22 is rotated to circulate a protection belt 21 and the printing medium 2 is conveyed together with the protection belt 21 in a medium conveyance direction, as illustrated in FIG. 6, a slack 9 of the printing medium 2 arises near a nip between the conveyance roller 22 and an opposing roller 24, at which the protection belt 21 is flattened.

Comparing the protection belt 21 with the printing medium 2, the printing medium 2 is extended at the vicinity of the conveyance roller 22 because the printing medium 2 circulates along an outer circumference of the protection belt 21. When such an extended portion of the printing medium 2 is conveyed to a flat surface of the protection belt 21, the extended portion is slacked as a surplus. For a printing medium having no adhesive face, such as plain paper, the printing medium slides over the protection belt 21, thus naturally canceling the slack. By contrast, for the printing medium 2 having the adhesive face, since the printing medium 2 adheres to the protection belt 21 with low adhesion, the printing medium 2 does not slide over the protection belt 21, thus preventing the slack from being canceled.

As the printing medium 2 is more conveyed, the slack 9 is enlarged and compressed between the conveyance roller 22 and the opposing roller 24, thus resulting in wrinkles of the printing medium 2.

Here, experiments of the winding angle β and occurrence of wrinkles are described below. FIG. 7 shows results of the experiments.

As seen from the results in FIG. 7, setting the approach angle α (winding angle β) within a range from 0° to 30° prevents occurrence of wrinkles.

Hence, in this embodiment, the winding angle β (i.e., the approach angle α of the printing medium) is set within the range from 0° to 30°. Specifically, the media roll 4 is disposed so that an angle formed by the support face of the protection belt 21 and a tangent of the conveyance roller 22 passing the center of the media roll 4 is within the range from 0° to 30°.

As described above, where an angle formed by the printing medium drawn from the media roll and approaching to between the paired rotary bodies and the face (support face) of the protection belt opposing the image forming device is the approach angle of the printing medium, setting the approach angle within the range from 0° to 30° can prevent occurrence of wrinkles.

Next, a second embodiment of this disclosure is described with reference to FIG. 8.

Figure 8:
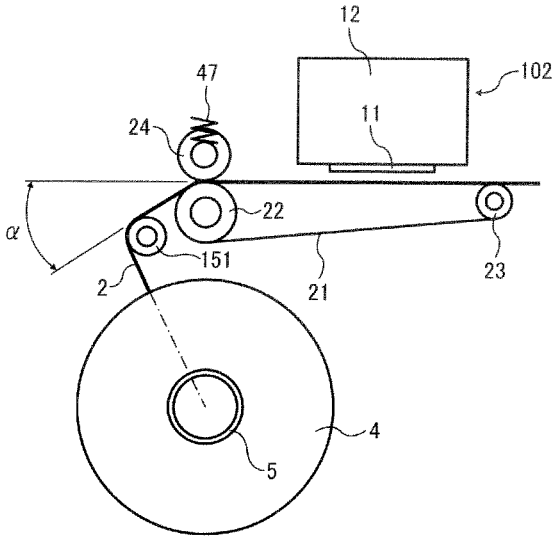
FIG. 8 is a partial front view of an image forming apparatus according to a second embodiment of this disclosure.

FIG. 8 is a partial front view of an image forming apparatus according to the second embodiment of this disclosure.

In this embodiment, a media roll 4 is disposed below a conveyance roller 22.

Between the media roll 4 and the conveyance roller 22, a guide roller (auxiliary roller) 151 to contact the adhesive face 2*b* of the printing medium 2 and guide the printing medium 2. A circumferential surface of the guide roller 151 has a release layer (e.g., silicone coating of a surface layer) which is processed for non-adhesion.

The guide roller 151 is an auxiliary rotary body to define the approach angle α of the printing medium 2 and is disposed at such a position that the approach angle α of the printing medium is within the range from 0° to 30°. Here, an angle formed by a tangent connecting the circumferential surface of the guide roller 151 to a circumferential surface of the conveyance roller 22 and a support face of the protection belt 21 is within the range from 0° to 30°.

According to this embodiment, since the approach angle α of the printing medium 2 is defined by the guide roller 151, the media roll 4 can be freely positioned below the conveyance roller 22, thus allowing downsizing of the image forming apparatus.

Next, a third embodiment of this disclosure is described with reference to FIGS. 9A and 9B.

Figure 9A:
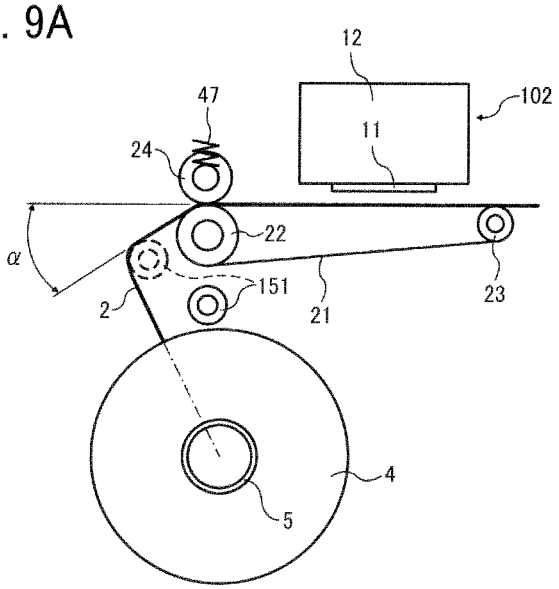
FIGS. 9A and 9B are partial front views of an image forming apparatus according to a third embodiment of this disclosure.
Figure 9B:
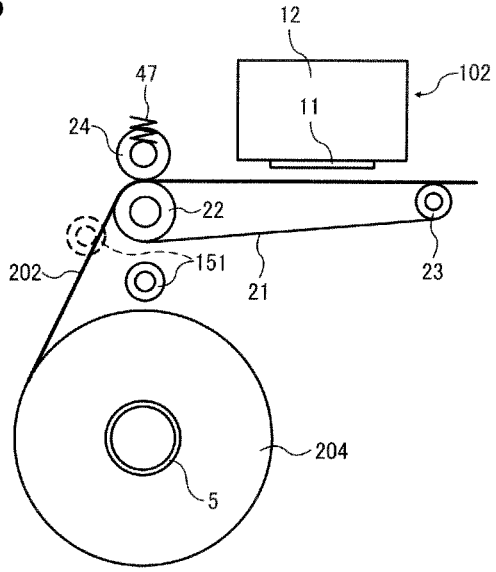

FIGS. 9A and 9B are partial front views of an image forming apparatus according to the third embodiment of this disclosure.

In this embodiment, the guide roller 151 serving as the auxiliary rotary body in the above-described second embodiment is arranged to be movable between a position (first position), indicated by a broken line in FIG. 9A, at which the approach angle α of the printing medium is within the range from 0° to 30° and a position (second position), indicated by a solid line in FIG. 9A, at which the approach angle α of the printing medium is greater than 30°.

Such a configuration can enhance the feeding accuracy of a printing medium when, as illustrated in FIG. 9B, no adhesive face adheres to the protection belt 21, for example, when a printing medium having no adhesive face or a printing medium having a protection member, such as release paper, on an adhesive face (each of which is referred to as "printing medium 202") rolled into a roll shape is used as the media roll 204. Even for a linerless label sheet, the same is true when the linerless label sheet is fed as a printing medium 2 so that printing is performed on an adhesive face 2*b* thereof.

In other words, when no adhesive face adheres to the protection belt 21, no wrinkles occurs in the printing medium 2 due to the winding angle of the printing medium 2 relative to the circumferential surface of the conveyance roller 22. Hence, when no adhesive face adheres to the protection belt 21, the guide roller 151 is moved to the second position indicated by the solid line in FIG. 9A to increase the winding angle of the printing medium 2 relative to the conveyance roller 22. Increasing the winding angle enhances the feeding accuracy of the printing medium 2 with rotation of the conveyance roller 22.

By contrast, when the protection belt 21 protects the adhesive face 2*b* as in the above-described embodiments, moving the guide roller 151 to the first position indicated by the broken line in FIG. 9A can set the approach angle α of the printing medium 2 within the range from 0° to 30°, thus reducing occurrence of wrinkles.

Next, a fourth embodiment of this disclosure is described with reference to FIG. 10.

Figure 10:
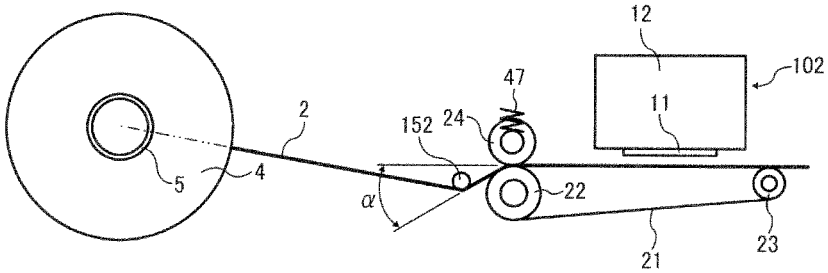
FIG. 10 is a partial front view of an image forming apparatus according to a fourth embodiment of this disclosure.

FIG. 10 is a partial front view of an image forming apparatus according to the fourth embodiment of this disclosure.

In this embodiment, a media roll 4 is disposed below a conveyance roller 22.

Between the media roll 4 and the conveyance roller 22, a guide roller 152 serving as an auxiliary rotary body is disposed to contact a printing face 2*a* of a printing medium 2 and guide the printing medium 2.

The guide roller 152 is disposed at such a position that the approach angle α of the printing medium is within the range from 0° to 30°. In this embodiment, the guide roller 152 is disposed at such a position that an angle formed by a tangent connecting a circumferential surface of the guide roller 152 to a circumferential surface of the conveyance roller 22 and a support face of a protection belt 21 is within the range from 0° to 30°.

Such a configuration can obtain an operation effect equivalent to that of the above-described first embodiment.

Next, a fifth embodiment of this disclosure is described with reference to FIG. 11.

Figure 11:
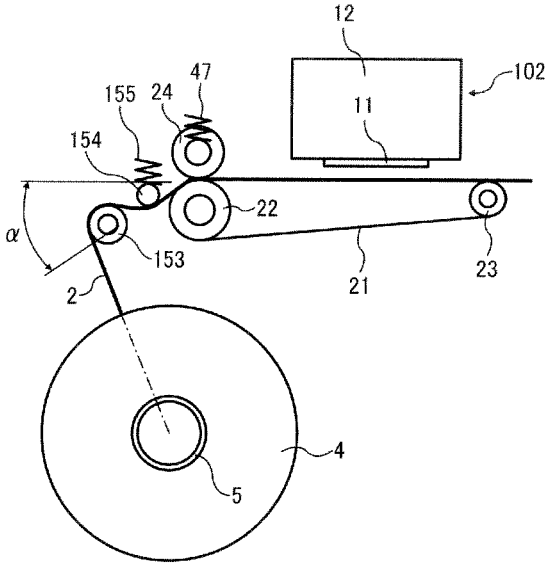
FIG. 11 is a partial front view of an mage forming apparatus according to a fifth embodiment of this disclosure.

FIG. 11 is a partial front view of an image forming apparatus according to the fifth embodiment of this disclosure.

In this embodiment, a media roll 4 is disposed below a conveyance roller 22.

Between the media roll 4 and the conveyance roller 22, a first guide roller 153 is disposed at an upstream side and a second guide roller 154 serving as an auxiliary rotary body is disposed at a downstream side in a feed direction of the printing medium 2. A spring 155 is disposed to press the second guide roller 154 downward.

The first guide roller 153 contacts an adhesive face 2*b* of the printing medium 2 and guides the printing medium 2. A circumferential surface of the first guide roller 153 has a release layer (silicone coating of a surface layer) which is processed for non-adhesion.

The second guide roller 154 is disposed between the first guide roller 153 and the conveyance roller 22 and serves as an intermediate roller to contact the printing face 2*a* of the printing medium 2 and guide the printing medium 2.

The guide roller 154 is disposed at such a position that the approach angle α of the printing medium is within the range from 0° to 30° and the second guide roller 154 can apply tension to the printing medium 2.

For such a configuration, the second guide roller 154, while defining the approach angle α can cancel a slack of the printing medium 2 between the first guide roller 153 and the conveyance roller 22 by applying tension to the printing medium 2. Accordingly, the printing medium 2 can be fed at a good condition free of wrinkles or slack.

Next, an image forming apparatus according to a sixth embodiment of this disclosure is described with reference to FIG. 12.

Figure 12:
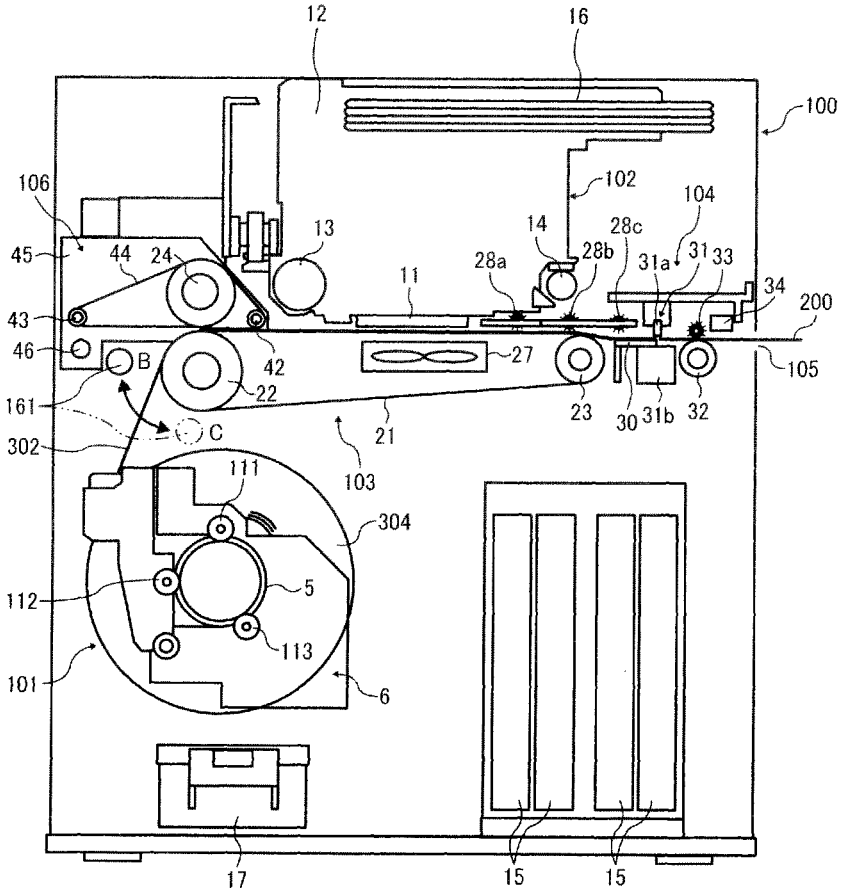
FIG. 12 is a front view of an image forming apparatus according to a sixth embodiment of this disclosure.

FIG. 12 is a front view of the image forming apparatus according to the sixth embodiment of this disclosure.

In this embodiment, a media roll 304 formed of a printing medium 302 wound in a roll shape is disposed below a conveyance roller 22. The printing medium 302 corresponds to the printing medium 2 or the printing medium 202 in the above-described embodiments.

A relay roller 161 is disposed between the media roll 304 and the conveyance roller 22.

The relay roller 161 is movable between a position (hereinafter, position B), indicated by a solid line in FIG. 12, at which the relay roller 161 defines the approach angle α of the printing medium and acts as a wrinkle prevention roller and a position (hereinafter, position C), indicated by a broken line in FIG. 12, at which the relay roller 161 acts as a decurler (decurling roller).

As described above, in this embodiment, the relay roller 16*l* serves as both the wrinkle prevention roller and the decurling roller, thus achieving a simplified configuration.

In other words, if a printing medium is curled, the curled printing medium might rub against a recording head, thus resulting in an image failure or damage to the head. Hence, a decurler is employed to flatten the curled printing medium. The decurler may flatten the curled printing medium with, for example, pressure arising when the printing medium is nipped by roller members or by biting rollers with each other.

To flatten the curled printing medium, it may be effective to bend the curled printing medium at a large curvature in a direction opposite a winding direction of the media roll 304.

For this embodiment, by feeding a curled printing medium to the conveyance roller 22 via the right side of the relay roller 161 placed at the position C in FIG. 12, such a curvature in the direction opposite the winding direction of the media roll 304 can be applied to the printing medium 302.

By contrast, if a printing medium having an adhesive face is fed to between the paired rotary bodies at a large approach angle as described above, wrinkles is likely to occur in the printing medium. Hence, as described above, the relay roller 161 is placed at the position B to decrease the approach angle α of the printing medium.

Here, if a roller member used as a decurler and a wrinkle prevention roller (e.g., the auxiliary roller in the above-described embodiment) to decrease the approach angle are provided separately from each other, the image forming apparatus would have an increased apparatus size, a more complicated configuration, and a reduced performance in setting printing media.

Hence, in this embodiment, a single roller member is configured to act as both a wrinkle prevention roller (auxiliary rotary body) and a decurling roller. Such a configuration can suppress upsizing of the apparatus, provide a simplified configuration, and prevent a reduction in user's performance of setting printing media.

Next, a method of setting printing media in this embodiment is described with reference to FIGS. 13 to 16.

Figure 13:
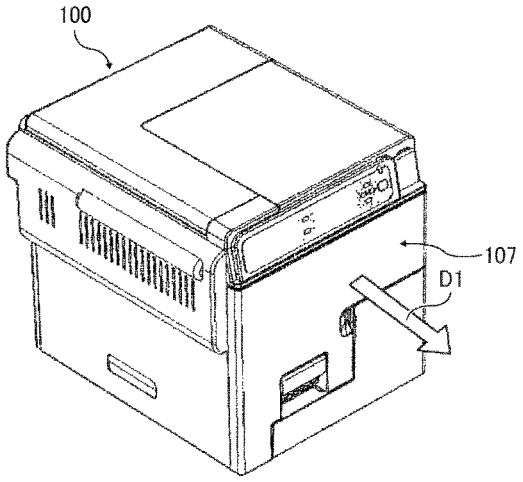
FIG. 13 is an outer perspective view of the image forming apparatus according to the sixth embodiment of this disclosure.
Figure 14:
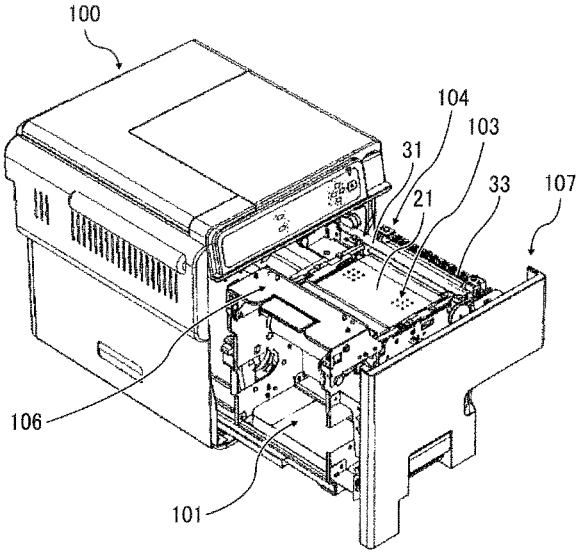
FIG. 14 is a perspective view of the image forming apparatus according to the sixth embodiment in a state in which a sheet feeding conveyance unit is drawn from an apparatus body.
Figure 15:
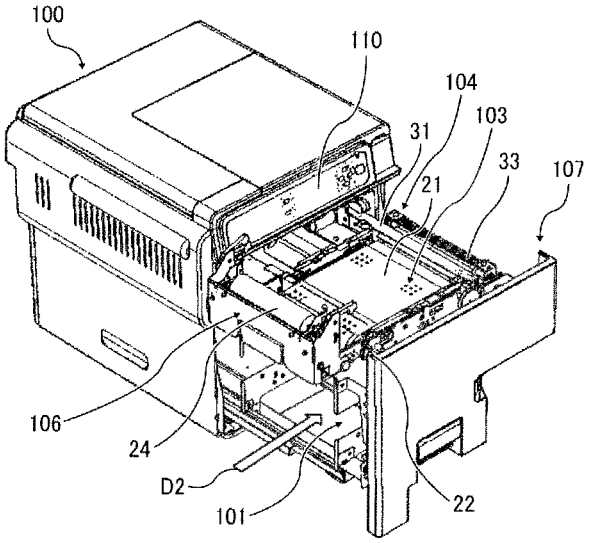
FIG. 15 is a perspective view of the image forming apparatus according to the sixth embodiment in a state in which an opposing roller is released.
Figure 16:
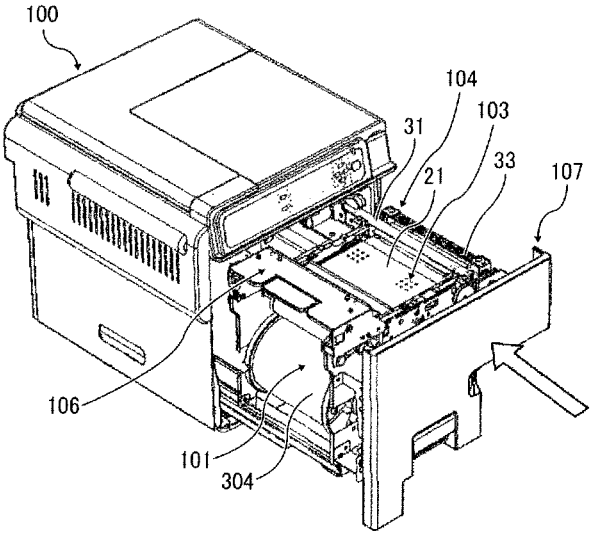
FIG. 16 is a perspective view of the image forming apparatus according to the sixth embodiment in a state in which a media roll is loaded and a printing medium is set on a protection belt.

FIG. 13 is an outer perspective view of the image forming apparatus according to this embodiment. FIG. 14 is a perspective view of the image forming apparatus in a state in which a sheet feeding conveyance unit is drawn from the apparatus body. FIG. 15 is a perspective view of the image forming apparatus in a state in which an opposing roller is released. FIG. 16 is a perspective view of the image forming apparatus in a state in which the media roll is loaded and the printing medium is set on the protection belt.

In this embodiment, the image forming apparatus includes a sheet feeding unit 101, a conveyance unit 103, and a discharge conveyance unit 104 as a single integrated unit of a sheet feeding conveyance unit 107. As illustrated in, e.g., FIG. 14, the sheet feeding conveyance unit 107 is installed relative to the apparatus body 100 in a state in which the sheet feeding conveyance unit 107 is drawable from the apparatus body 100 in a direction perpendicular to a medium conveyance direction.

When a (new or replacement) media roll 304 is loaded to the sheet feeding unit 101 and a printing medium 302 is set on the protection belt 21, as illustrated in FIG. 14, the urging member 107 is drawable from the apparatus body 100 in a direction indicated by arrow D1 in FIG. 13.

At this time, the sheet feeding conveyance unit 107 is drawn to a position at which the media roll 304 can be mounted to the sheet feeding unit 101 from the conveyance direction of the printing medium 302 in the conveyance unit 103 and a user can see the protection belt 21.

As illustrated in FIG. 15, the opposing roller 24 is retracted upward and an area between the opposing roller 24 and the conveyance roller 22 is opened.

The media roll 304 is loaded to the sheet feeding unit 101 in a direction indicated by arrow D2 in FIG. 15. The printing medium 302 is drawn from the media roll 304, and a leading end of the printing medium 302 is passed through between the opposing roller 24 and the conveyance roller 22 and set to a desired opposition on the protection belt 21.

As illustrated in FIG. 16, the opposing roller 24 is returned to an original position, and the printing medium 302 and the protection belt 21 are sandwiched together between the conveyance roller 22 and the opposing roller 24.

Next, the sheet feeding conveyance unit 107 is pushed into the apparatus body 100, and thus the setting is completed.

Next, an example of a moving assembly of moving the relay roller (hereinafter, relay-roller moving assembly) is described with reference to FIGS. 17 and 18.

Figure 17:
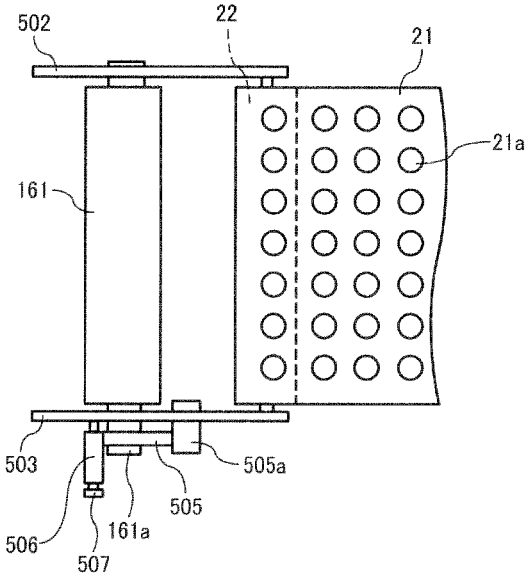
FIG. 17 is a partial front view of a relay-roller moving assembly in the sixth embodiment.
Figure 18:
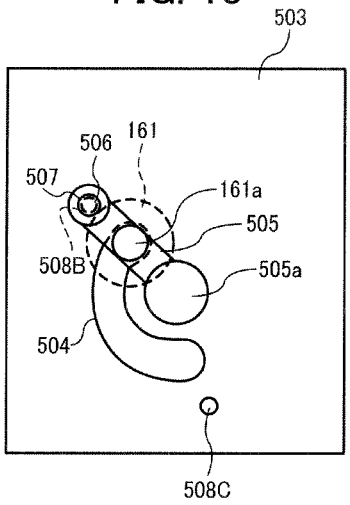
FIG. 18 is a partial front view of the relay-roller moving assembly in the sixth embodiment.

FIG. 17 is a partial plan view of a relay-roller moving assembly according to this embodiment. FIG. 18 is a partial front view of the relay-roller moving assembly. The relay roller 161 has shaft portions 161*a* supported by and movable in guide grooves 504 of side plates 502 and 503. One of the shaft portions 161*a* of the relay roller 161 is rotatably supported by a lever 505 that is rotatably supported by the side plate 503. The protection belt 21 has multiple suction holes 21*a*.

The lever 505 has a shaft portion 505*a* coincident with a central axis of a movement trajectory of the relay roller 161. The shaft portion 505*a* is rotatably supported by the side plate 503. The lever 505 has a grip 506 at an end opposite an end at which the lever 505 has the shaft portion 505*a*.

A fixation screw 507 penetrating through the grip 506 is screwed into a screw hole 508B, and as a result, the grip 506 is fixed to the side plate 503, thus allowing the relay roller 161 to be fixed at a position (position B) at which the relay roller 161 acts as the wrinkle prevention roller. Such a configuration can also fix the relay roller 161 at a position (position C) at which the relay roller 161 acts as the decurling roller.

Next, operation of the relay roller at the position at which the relay roller acts as the wrinkle prevention roller is described with reference to FIGS. 19A and 19B.

Figure 19A:
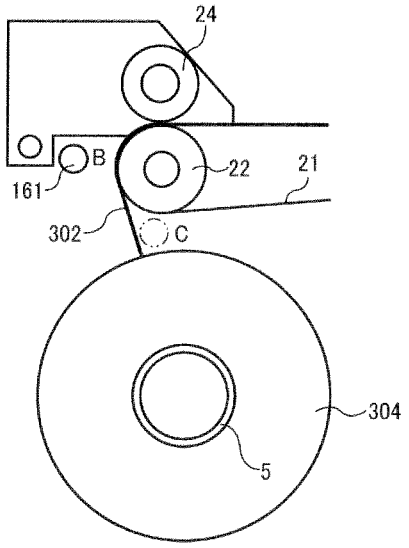
FIGS. 19A and 19B are partial front views of an example of operation of a relay roller at a position at which the relay roller acts as a wrinkle prevention roller.
Figure 19B:
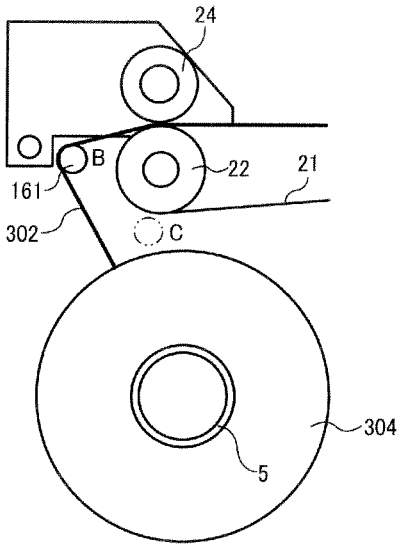

FIGS. 19A and 19B are partial front views of an example of the operation of the relay roller at the position.

FIG. 19A shows a route on which a printing medium 302 approaches to between the conveyance roller 22 and the opposing roller 24 without passing the relay roller 161.

When the printing medium 302 is a linerless label sheet like the printing medium 2 and an image is formed on an adhesive face of the printing medium 302, the adhesive face does not adhere to the protection belt 21, thus preventing occurrence of wrinkles. Hence, in such a case, the relay roller 161 can be controlled so as not to contact the adhesive face of the printing medium 302. As described above, bypassing the relay roller 161 allows an increase in an area opposing the conveyance roller 22, thus enhancing the friction force of the printing medium 302 against the conveyance roller 22. Accordingly, even if a face of the printing medium 302 opposing the conveyance roller 22 is not adhesive, such a configuration can stably convey the printing medium 302.

By contrast. FIG. 19B shows a route on which the printing medium 302 approaches to between the conveyance roller 22 and the opposing roller 24 via the relay roller 161.

When the printing medium 302 is a linerless label sheet like the printing medium 2 and an image is formed on a printing face of the printing medium 302, the adhesive face adheres to the protection belt 21, thus resulting in occurrence of wrinkles as described above. Hence, at this time, the relay roller 161 defines the approach angle of the printing medium 302, thus preventing occurrence of wrinkles. For such a configuration, the area of the printing medium 302 opposing the conveyance roller 22 is relatively small. However, adhesion of the adhesive face in addition to the friction force allows stable conveyance of the printing medium 302 even when the area is relatively small.

Next, operation of the relay roller at the position at which the relay roller acts as the decurler (decurling roller) is described with reference to FIGS. 20A and 20B.

Figure 20A:
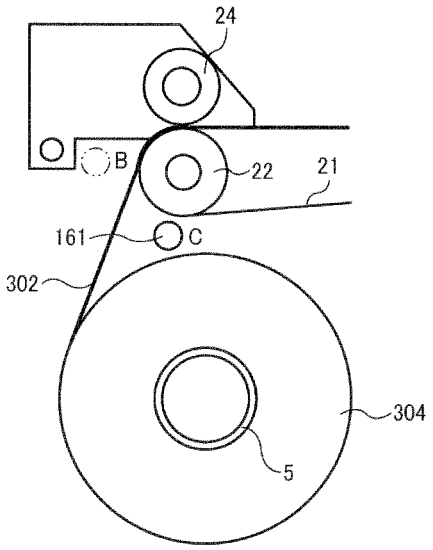
FIGS. 20A and 20B are partial front views of an example of operation of a relay roller at a position at which the relay roller acts as a decurler (decurling roller)
Figure 20B:
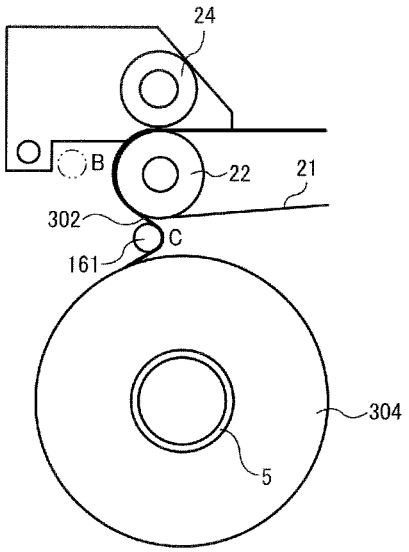

FIGS. 20A and 20B are partial front views of an example of the operation of the relay roller at the position.

FIG. 20A shows a route on which a printing medium 302 approaches to between the conveyance roller 22 and the opposing roller 24 without passing the relay roller 161.

When the printing medium 302 is a linerless label sheet like the printing medium 2 and an image is formed on an adhesive face of the printing medium 302, or when the printing medium 302 has no adhesive face like the printing medium 202 or a printing medium having a release sheet on an adhesive face thereof is used, the relay roller 161 is configured not to contact a printing face of the printing medium.

By contrast, FIG. 20B shows a route on which the printing medium 302 approaches to between the conveyance roller 22 and the opposing roller 24 via the relay roller 161.

The relay roller 161 can decurl downward curling of the printing medium 302.

An example in which different positions and effects of the relay roller are used in accordance with the above-described types of printing media.

In FIG. 21, the term "label with liner" represents a printing medium having a liner (release paper) to protect an adhesive face thereof. The term "linerless label" represents a printing medium having a printing face at one side and an adhesive face at the other side. The term "back-face printing label" represents a printing medium made of a transparent base material and having an adhesive face at one side on which printing is performed.

Figure 23:
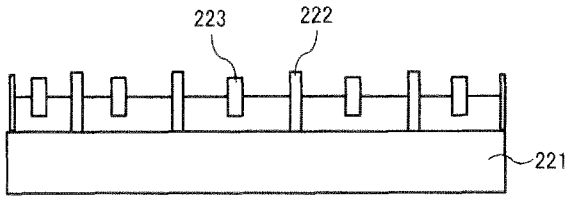
FIG. 23 is a front view of a conveyance unit in the seventh embodiment.
Figure 24:
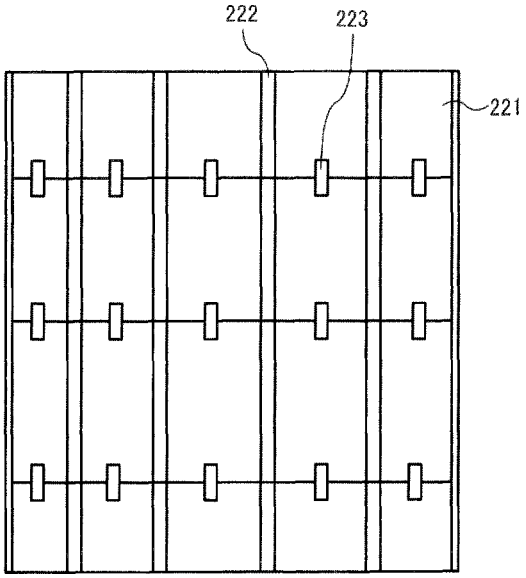
FIG. 24 is a plan view of the conveyance unit of FIG. 23.

Next, an image forming apparatus according to a seventh embodiment of this disclosure is described with reference to FIGS. 22 to 24.

Figure 22:
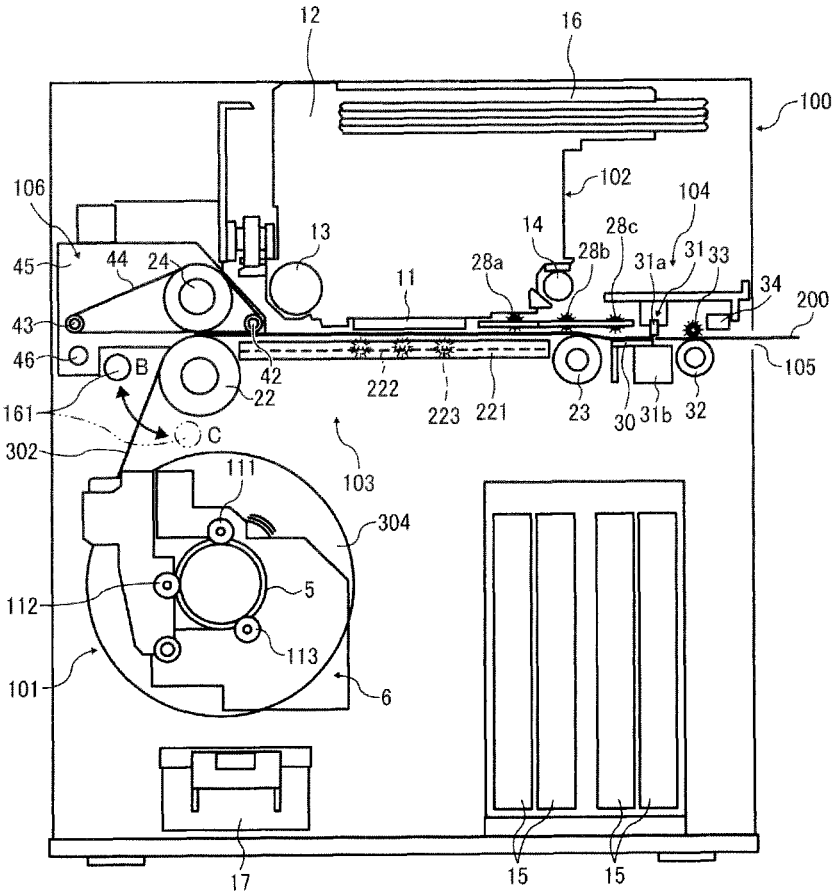
FIG. 22 is a front view of the image forming apparatus according to a seventh embodiment of this disclosure.

FIG. 22 is a front view of the image forming apparatus according to this embodiment. FIG. 23 is a side view of a conveyance unit in this embodiment. FIG. 24 is a plan view of the conveyance unit of FIG. 23.

In this embodiment, without using the protection belt described in each of the above-described embodiments, the image forming apparatus uses ribs 222 of a platen member 221 and spur rollers 223 between the ribs 222 to guide a printing medium 302 so that the printing medium 302 opposes an image forming unit 102. Each of the ribs 222 has a receiving face to receive the printing medium 302, and the receiving face is processed for non-adhesion.

Other configurations of this embodiment are similar to those of the above-described sixth embodiment, and therefore descriptions thereof are omitted here.

Even when such a configuration is employed, using a single roller member as both the wrinkle prevention roller (auxiliary rotary body) and the decurling roller (decurler) suppresses upsizing of the image forming apparatus, provides a more simplified configuration, and prevents a reduction in user's performance in setting printing media.

Next, an eighth embodiment of this disclosure is described with reference to FIGS. 25 and 26.

Figure 25:
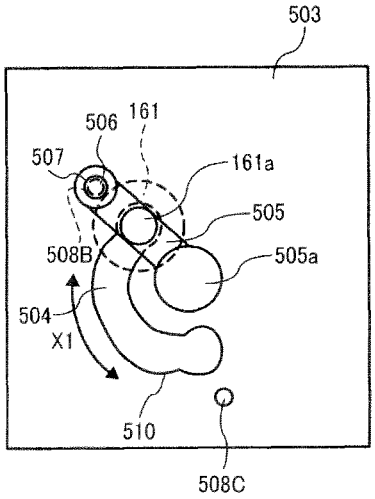
FIG. 25 is a partial front view of a relay-roller moving assembly in an image forming apparatus according to an eighth embodiment of this disclosure.
Figure 26:
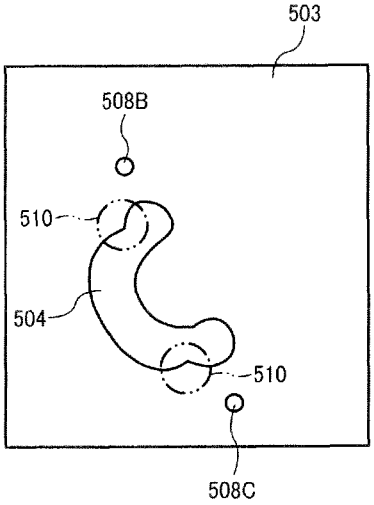
FIG. 26 is a partial front view of a shape of a guide groove of a side plate in the eighth embodiment.

FIG. 25 is a partial front view of a relay-roller moving assembly in this embodiment. FIG. 26 is a partial front view of a shape of a guide groove of a side plate in this embodiment.

In this embodiment, a guide groove 504 is partially narrowed with elastic members 510. The elastic members 510 are located near a position B at which a relay roller 161 acts as a wrinkle prevention roller and a position Cat which the relay roller 161 acts as a decurler.

Such a configuration allows temporal fixation of a shaft 161*a* of the relay roller 161. In other words, a user grips a grip of a lever 505 to handle the relay roller 161 and move the relay roller 161 to a direction indicated by X1 in FIG. 25. At this time, when the shaft 161*a* is moved to a position (position B or C) passing each of the elastic members 510, the relay roller 161 becomes unlikely to move in the opposite direction, thus allowing temporal fixation. Accordingly, a user can work with both hands, thus facilitating setting of the printing medium 302 or fastening of a fixation screw 507.

Next, a ninth embodiment of this disclosure is described with reference to FIG. 27.

Figure 27:
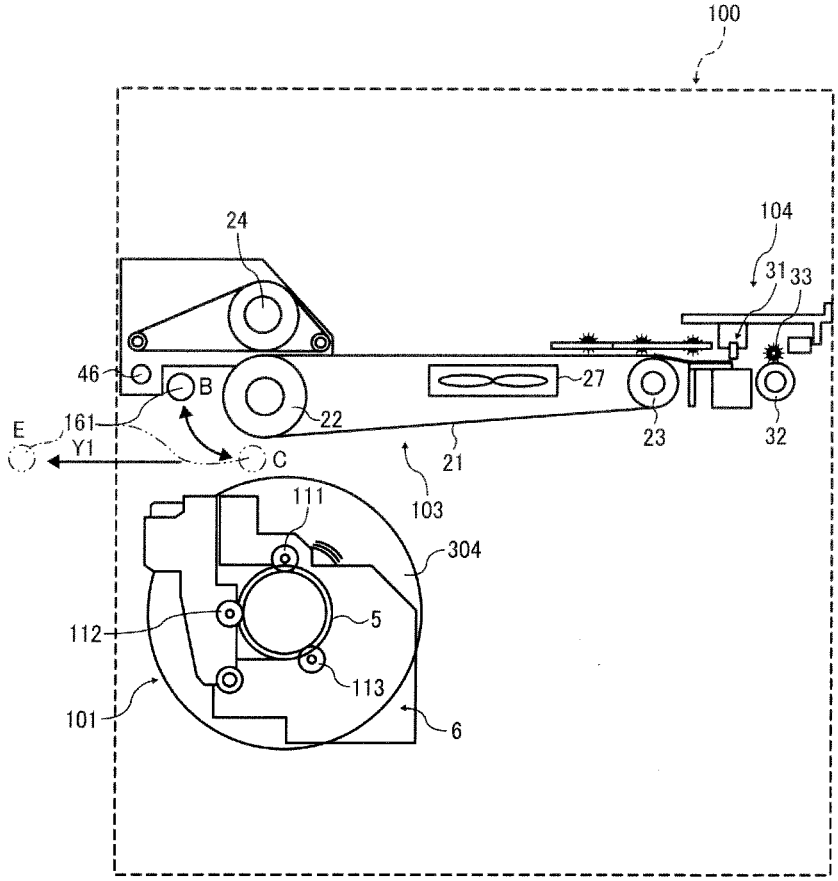
FIG. 27 is a partial front view of an image forming apparatus according to a ninth embodiment of this disclosure.

FIG. 27 is a front view of an image forming apparatus according to this embodiment.

In this embodiment, as described in the sixth embodiment, a sheet feeding conveyance unit 107 is drawable from an apparatus body 100. In a direction along a medium conveyance direction, a relay roller 161 is movable in a direction indicated by arrow Y1 from the sheet feeding conveyance unit 107 to a position E in FIG. 27 outside the apparatus body 100.

After the sheet feeding conveyance unit 107 is drawn as illustrated in FIG. 14 described above, as illustrated in FIG. 27, the relay roller 161 is moved to the position E. Such a configuration can obtain a space for a user to put his/her hands into, thus enhancing the setting performance of the printing medium 302.

When the setting of the printing medium 302 is completed, the relay roller 161 is moved in an order of position E, position C, (and position B). Then, the sheet feeding conveyance unit 107 is put into the apparatus body 100.

Next, an example of a relay-roller moving assembly of the relay roller in this embodiment is described with reference to FIGS. 28 and 29.

Figure 28:
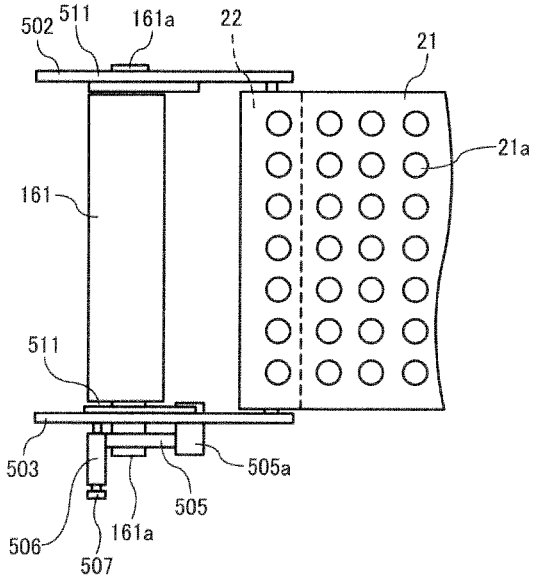

FIG. 28 is a plan view of the relay-roller moving assembly in a state in which the relay roller is put in. FIG. 29 is a plan view of the relay-roller moving assembly in a state in which the relay roller is pulled out.

Each of shaft portions 161*a* of the relay roller 161 has a spring inside the shaft portion 161*a*. By pushing ends of the shaft portions 161, the axial length of the relay roller 161 in a longitudinal direction thereof is adjustable. Between the relay roller 161 and each of side plates 502 and 503 is disposed a rail member 511 that is constituted of a plurality of members and can extend and contract.

Figure 29:
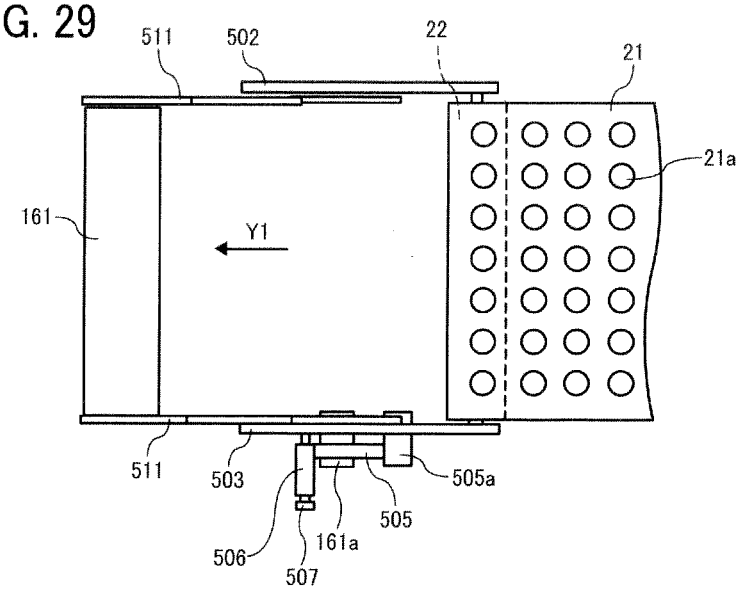
FIG. 29 is a plan view of the relay-roller moving assembly in the ninth embodiment in a state in which the relay roller is pulled out.

Thus, when the axial length is reduced by pushing the shaft portions 161*a* of the relay roller 161 from both sides, as illustrated in FIG. 29, each of the ends of the shaft portions 161*a* engages the rail member 511, thus causing the relay roller 161 to a drawable state in the direction indicated by arrow Y1. In this state, the relay roller 161 is pulled in the direction indicated by arrow Y1 in FIG. 29 and pulled out to the position E in FIG. 27.

Here, an example of the rail member 511 is described with reference to FIG. 30.

Figure 30:
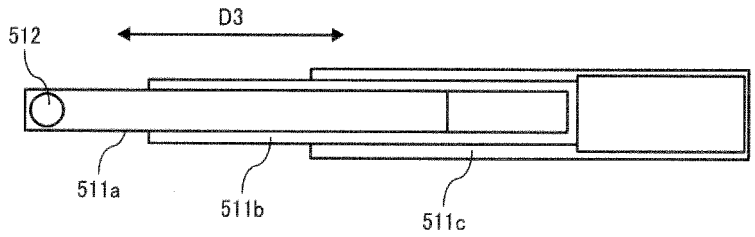
FIG. 30 is a front view of an example of a rail member in the ninth embodiment.

FIG. 30 is a front view of the rail member 511.

The rail member 511 includes, for example, a rail 511*a*, a rail 511*b*, and a rail 511*c* and is extendable and contractable in a direction indicated by arrow D3. The rail 511*a* has a bearing hole 512 to engage one of the shaft portions 161*a* of the relay roller 161.

Such a configuration allows push and pull of the relay roller.

Next, an example of the relay roller 161 is described with reference to FIG. 31.

Figure 31:
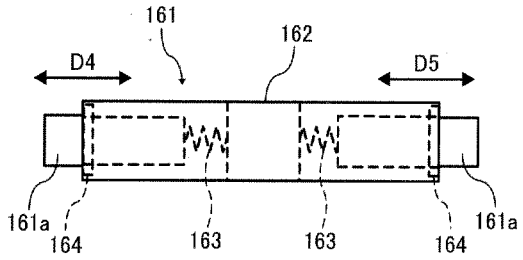
FIG. 31 is a front view of the relay roller in the ninth embodiment.

FIG. 31 is a front view of the relay roller 161 in this embodiment.

For the relay roller 161 illustrated in FIG. 31, shaft portions 161*a* are inserted to opposed ends of a hollow roller portion 162 so as to be movable back and forth in a direction indicated by arrow D4 and arrow D1 The shaft portions 161*a* are pressed outward by springs 163 disposed inside the roller portion 162. Each shaft portion 161*a* also has a stopper 164 to regulate an protruding amount thereof. In other words, the springs 163 serve as pressing members to press the shaft portions 161*a* in an axial direction of the relay roller 161.

Such a configuration allows the length of the shaft portion 161*a* to be shortened by pushing the shaft portion 161*a* into the roller portion against the spring 163.

Next, a tenth embodiment of this disclosure is described with reference to FIGS. 32A and 32B.

Figure 32A:
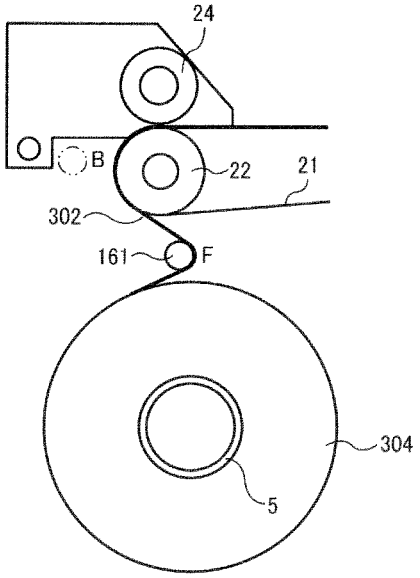
FIGS. 32A and 32B are partial front views of an image forming apparatus according to a tenth embodiment of this disclosure.
Figure 32B:
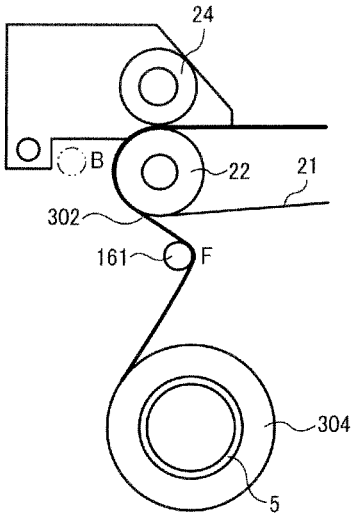

FIGS. 32A and 32B are partial front views of an image forming apparatus according to this embodiment.

In this embodiment, a relay roller 161 is movable between a position B at which the relay roller 161 acts as a wrinkle prevention roller and a position F at which the winding angle of the printing medium 302 relative to the relay roller 161 is fully large regardless of the roll diameter of a media roll 304. To obtain a large winding angle of the relay roller 161 relative to the relay roller 161, the position F is located at a side opposite a side at which the printing medium 302 is drawn from the media roll 304 with respect to a line connecting the axis of the conveyance roller 22 and the axis of the media roll 304.

The decurler preferably has a large winding angle relative to the printing medium because the decurling effect varies with the winding angle relative to the printing medium. By moving the relay roller 161 to the position F, a good decurling effect can be obtained in response to a change of a conveyance path of the printing medium caused by a change in the (roll) diameter of the media roll 304.

Here, an example of a relay-roller moving assembly in this embodiment described with reference to FIG. 33.

Figure 33:
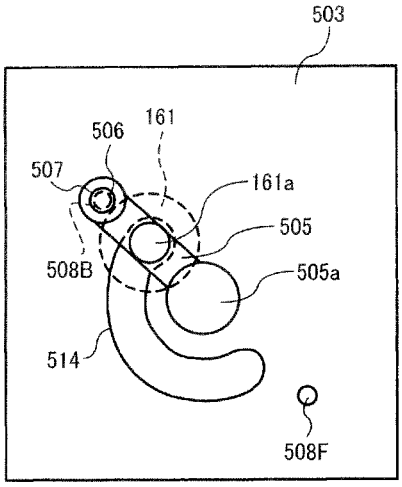
FIG. 33 is a partial front view of an example of a relay-roller moving assembly in the tenth embodiment.

FIG. 33 is a partial front view of the relay-roller moving assembly in this embodiment.

The relay-roller moving assembly according to this embodiment has a configuration similar to that of the relay-roller moving assembly according to the above-described sixth embodiment. A guide groove 514 is extended so that the relay roller 161 is movable to the position F. A spring hole 508F is provided so that, with a lever 505 stopped at the position F, the relay roller 161 is fastened at the position F.

Next, an eleventh embodiment of this disclosure is described with reference to FIGS. 34A and 34B.

Figure 34A:
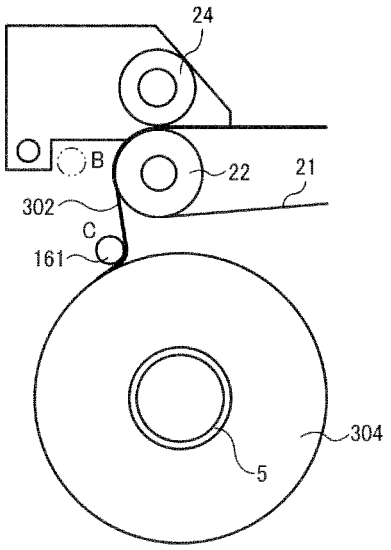
FIGS. 34A and 34B are partial front views of an image forming apparatus according to an eleventh embodiment of this disclosure.
Figure 34B:
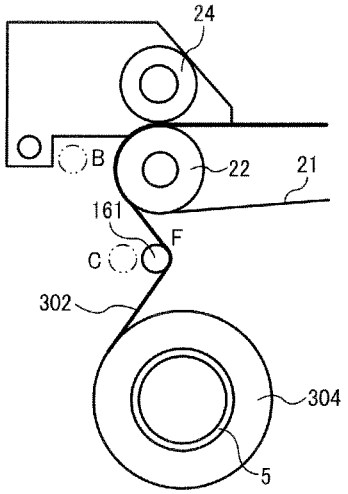

FIGS. 34A and 34B are partial front views of an image forming apparatus according to the eleventh embodiment of this disclosure.

In this embodiment, the position at which a relay roller 161 acts as a decurler is adjustable with the roll diameter of the media roll 304. In other words, the relay roller 161 is also movable between a position C illustrated in FIG. 34A and a position F illustrated in FIG. 34B.

As described above, the winding angle of the printing medium 302 relative to the relay roller 161 can be adjustable by moving the relay roller 161 in accordance with the diameter of the media roll 304.

Here, an example of a relay-roller moving assembly in this embodiment is described with reference to FIG. 35.

Figure 35:
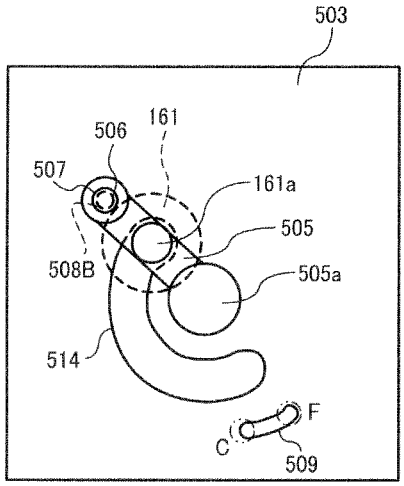
FIG. 35 is a partial front view of an example of a relay-roller moving assembly in the eleventh embodiment.

FIG. 35 is a partial front view of the relay-roller moving assembly in this embodiment.

Similarly to the relay-roller moving assembly according to the above-described tenth embodiment, the relay-roller moving assembly according to this embodiment has a guide groove 514 extended so that the relay roller 161 is movable to a position F. A spring hole 509 having a groove shape is provided to stop a lever 505 at a desired position between a position C and the position F. One end of the spring hole 509 is disposed at a position corresponding to the position C. The opposite end of the spring hole 509 is disposed at a position corresponding to the position F.

For such a configuration, in a case in which a user adjusts the position of the relay roller 161 in accordance with the roll diameter of a media roll 304, the user fixes the lever 505 by screwing a fixation screw 507 into a screw hole 508B when the user uses the relay roller 161 as the wrinkle prevention roller.

Alternatively, when the user uses the relay roller 161 as the decurler, by screwing the fixation screw 507 into the screw hole 509, the user fixes the lever 505 in accordance with a desired position between the position C and the position F.

Figure 36:
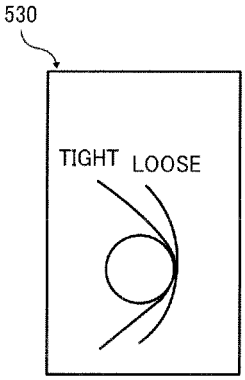
FIG. 36 is a partial front view of an example of an index of the relay-roller moving assembly in the eleventh embodiment.

In such a case, as illustrated in FIG. 36, for example, an index 530 is stuck on a side plate 503 or other member to indicate at how much angle the printing medium should be wound around the relay roller 161.

Next, a twelfth embodiment of this disclosure is described with reference to FIGS. 37A and 37B.

Figure 37A:
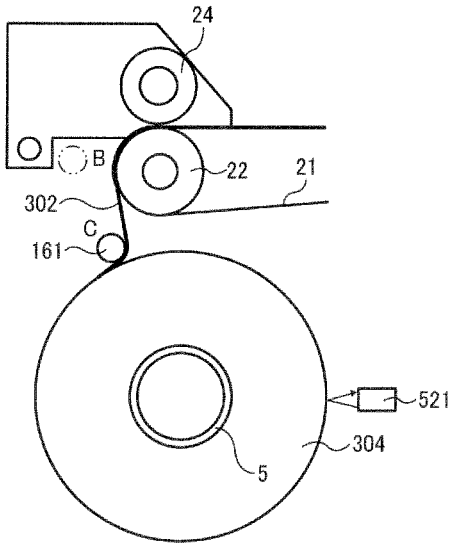
FIGS. 37A and 37B are partial front views of an image forming apparatus according to a twelfth embodiment of this disclosure.
Figure 37B:
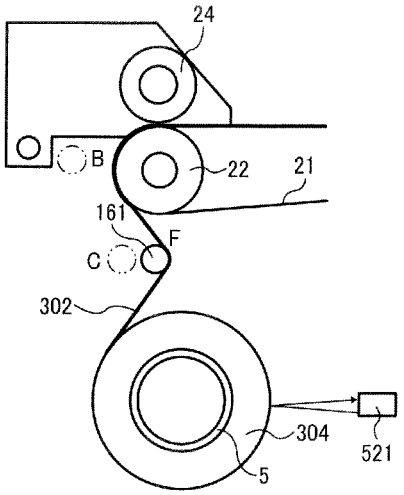

FIGS. 37A and 37B are partial front views of an image forming apparatus according to the twelfth embodiment of this disclosure.

In this embodiment, the image forming apparatus has a roll diameter sensor 521 to detect the roll diameter of a media roll 304. In this embodiment, the roll diameter sensor 521 is constituted of a reflection-type optical sensor and detects a distance to a circumferential surface of the media roll 304 to detect the roll diameter of the media roll 304.

In accordance with detection results of the roll diameter sensor 521, the lever 505 is rotated to move the relay roller 161 between the position C and the position F.

Next, an example of a relay-roller moving assembly in this embodiment is described with reference to FIG. 38.

Figure 38:
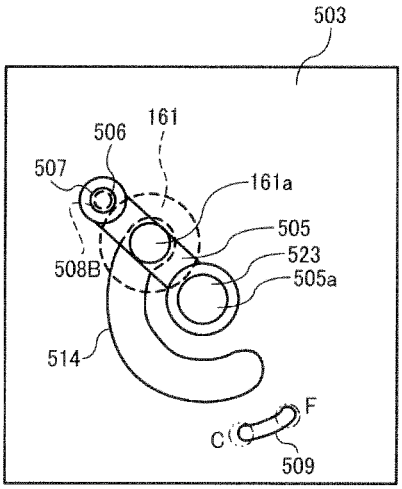
FIG. 38 is a partial front view of an example of a relay-roller moving assembly in the twelfth embodiment.

FIG. 38 is a partial front view of the relay-roller moving assembly in this embodiment.

Similarly to the relay-roller moving assembly according to the above-described eleventh embodiment, the relay-roller moving assembly according to this embodiment has a guide groove 514 extended so that a relay roller 161 is movable to a position F. A spring hole 509 having a groove shape is provided to stop a lever 505 at a desired position between a position C and the position F. One end of the spring hole 509 is disposed at a position corresponding to the position C. The opposite end of the spring hole 509 is disposed at a position corresponding to the position F.

The relay-roller moving assembly according to this embodiment further has a driving motor 523 to rotate a rotation shaft 505*a* of a lever 505.

By rotating the lever 505 with the driving motor 523, the position of the relay roller 161 is movable to a desired position between the position C and the position F. In such a case, the movement amount of the relay roller 161 can be detected with, for example, a rotary encoder coupled to the rotation shaft 505*a*.

Here, for example, after the relay roller 161 is moved with the driving motor 523, the relay roller 161 may be fixed with a fixation screw 507. Alternatively, without fixing the relay roller 161, the position of the relay roller 161 may be retained with torque of the driving motor 523 and automatically adjusted at given timings in accordance with detection results of the roll diameter sensor 521.

Next, a variation of the relay-roller moving assembly in this embodiment described with reference to FIG. 39.

Figure 39:
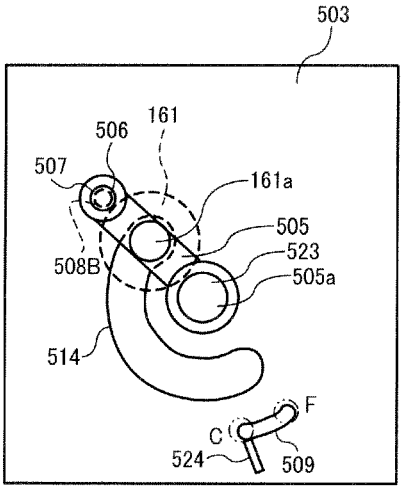
FIG. 39 is a partial front view of variation of the relay-roller moving assembly in the twelfth embodiment.

FIG. 39 is a partial front view of the variation of the relay-roller moving assembly in this embodiment.

In this variation, the relay-roller moving assembly includes a mechanical sensor 524 to detect that a grip 506 is placed between the position C and the position F.

Such a configuration can control the driving motor 523 to drive only when the relay roller 161 acts as the decurler.

Next, an image forming apparatus according to a thirteenth embodiment of this disclosure is described with reference to FIGS. 40 and 41.

Figure 40:
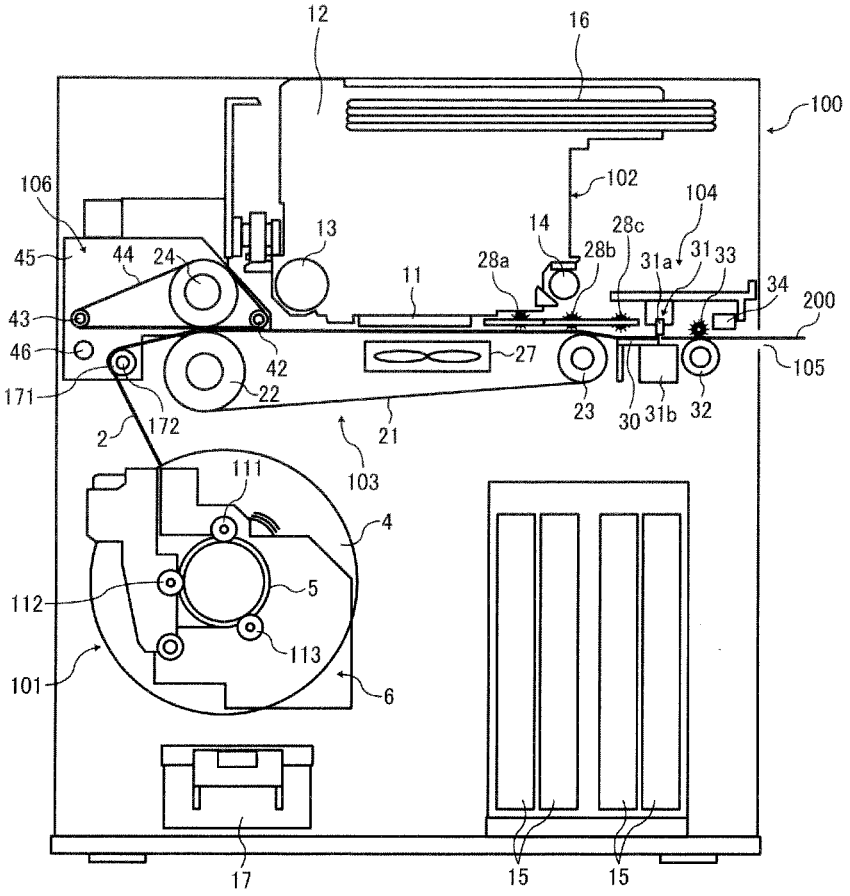
FIG. 40 is a front view of the image forming apparatus according thirteenth embodiment of this disclosure.
Figure 41:
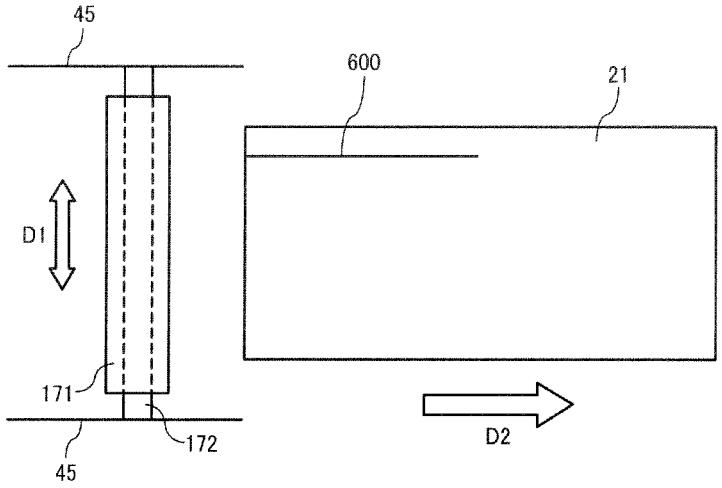
FIG. 41 is a partial plan view of the apparatus according to the thirteenth embodiment.

FIG. 40 is a front view of an image forming apparatus according to the thirteenth embodiment of this disclosure. FIG. 41 is a partial plan view of the image forming apparatus according to the thirteenth embodiment of this disclosure.

For the image forming apparatus according to this embodiment, a guide rod 172 is disposed between holder members 45 of a guide unit 106. An auxiliary roller 171 is movably fitted to the guide rod 172. The auxiliary roller 171 is disposed at such a position that the above-described approach angle α of the printing medium is within the range from 0° to 30°. The auxiliary roller 171 has a circumferential surface processed for non-adhesion.

Similarly to the above-described image forming apparatus illustrated in FIG. 12, the image forming apparatus according to this embodiment includes a sheet feeding unit 101, a conveyance unit 103, and a discharge conveyance unit 104 as a single integrated unit.

Figure 42A:
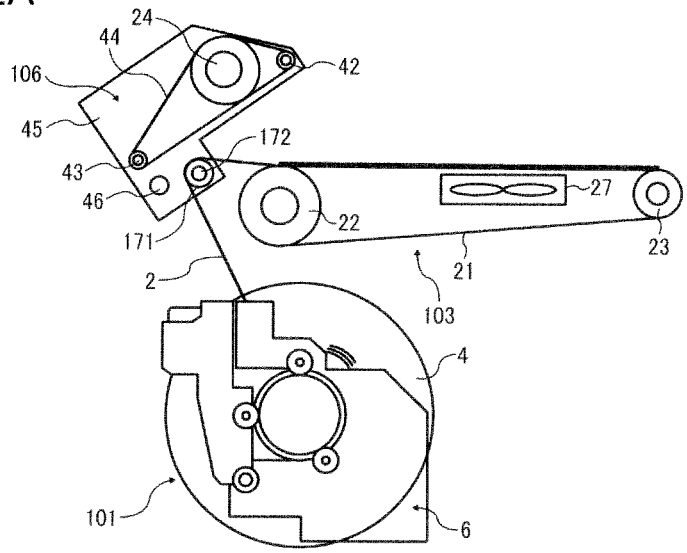
FIGS. 42A and 42B are partial front views of an image forming apparatus according to the thirteenth embodiment.

For the image forming apparatus having such a configuration, in a state in which the sheet feeding conveyance unit is pulled out, as illustrated in FIG. 42A, the guide unit 106 is rotated to a retracted position (release position). In this state, the printing medium 2 is put on the auxiliary roller 171 and set on a protection belt 21.

Figure 42B:
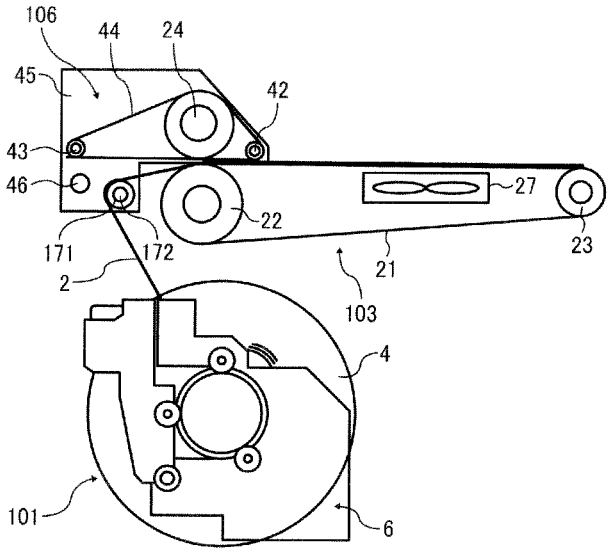

As illustrated in FIG. 42B, the guide unit 106 is closed. At this time, the position of the auxiliary roller 171 is placed so that the approach angle of the printing medium is within the range from 0° to 30°.

Here, when the guide unit 106 is released from a pressing position (an opposing roller 24 is separated from a conveyance roller 22), the auxiliary roller 171 is placed at a position higher than an upper face of the protection belt 21.

As described above, for the arrangement of the auxiliary roller 171 at the position higher than the protection belt 21, when the printing medium 2 is set, when the printing medium 2 is set, the printing medium 2 contacts the auxiliary roller 171 before contacting a curvature portion of the protection belt 21, thus enhancing the setting performance of the printing medium 2 having an adhesive face.

In other words, when the adhesive face of the printing medium 2 is positioned on the protection belt 21, the adhesive face does not slide over the protection belt 21. As a result, misregistration may not be corrected, thus making it difficult to accurately position the printing medium 2 on a curved surface of the protection belt 21. However, in this embodiment, the auxiliary roller 171 is placed at a high position so that the adhesive face does not contact the curvature portion of the protection belt 21 thus facilitating registration.

In addition, a positioning portion (index line) 600 is provided on the protection belt 21 to set the printing medium 2. The printing medium 2 is set on the protection belt 21 along the index line 600.

Figure 43:
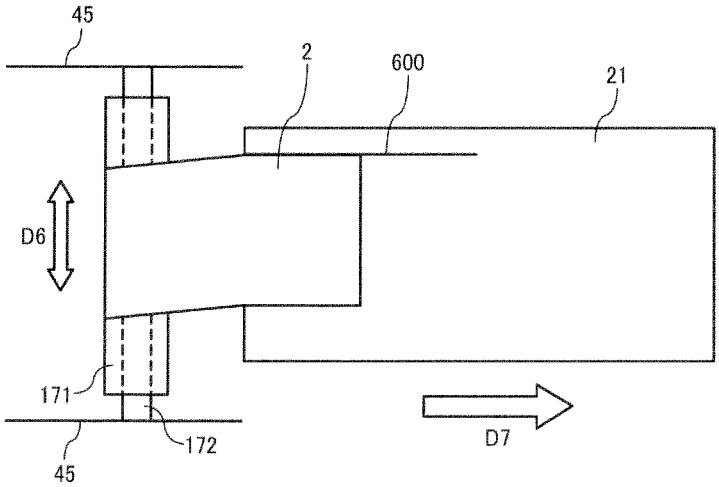
FIG. 43 is a plan view of the image forming apparatus according to the thirteenth embodiment in a state in which the position of a printing medium is shifted between an auxiliary roller and a protection belt.
Figure 44:
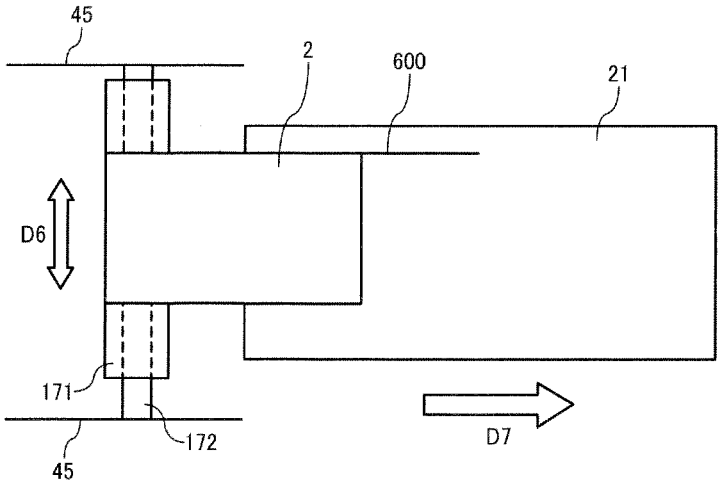
FIG. 44 is a plan view of the image forming apparatus according to the thirteenth embodiment in a state in which the shift of FIG. 43 is resolved.

At this time, as illustrated in FIG. 43, when the printing medium 2 adhere to the protection belt 21, the position of the printing medium 2 may be shifted between the auxiliary roller 171 and the protection belt 21. In such a case, as illustrated in FIG. 44, the misregistration between the printing medium 2 on the auxiliary roller 171 and the printing medium 2 on the protection belt 21 can be corrected by moving the auxiliary roller 171 along a direction (indicated by arrow D6) perpendicular to a conveyance direction of the printing medium 2 (indicated by arrow D7).

As described above, in this embodiment, when the printing medium is set, the auxiliary roller parallel to the conveyance roller around which the protection belt is wound is placed at a position higher than the upper face of the protection belt, and the auxiliary roller is movable in the axial direction thereof. Such a configuration allows the printing medium to be set on without influence of fixing with the auxiliary roller when the printing medium adheres to the protection belt.

Next, a fourteenth embodiment of this disclosure is described with reference to FIG. 45.

Figure 45:
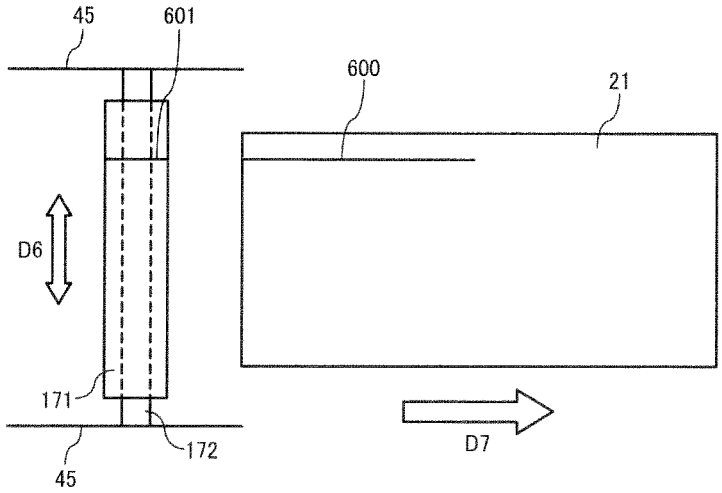
FIG. 45 is a partial front view of an image forming apparatus according to a fourteenth embodiment of this disclosure.

FIG. 45 is a partial front view of an image forming apparatus according to this embodiment.

For this embodiment, in the same configuration as that of the above-described thirteenth embodiment, the auxiliary roller 171 has an index line 601. The index line 601 is for example, a tape adhering to the auxiliary roller 171 or a marking made of non-erasable ink.

Such a configuration can regulate the position of the printing medium 2 adhering to the auxiliary roller 171 and prevent such a failure that the auxiliary roller 171 cannot move due to a shift of the auxiliary roller 171 to one side.

Next, a fifteenth embodiment of this disclosure is described with reference to FIG. 46.

Figure 46:
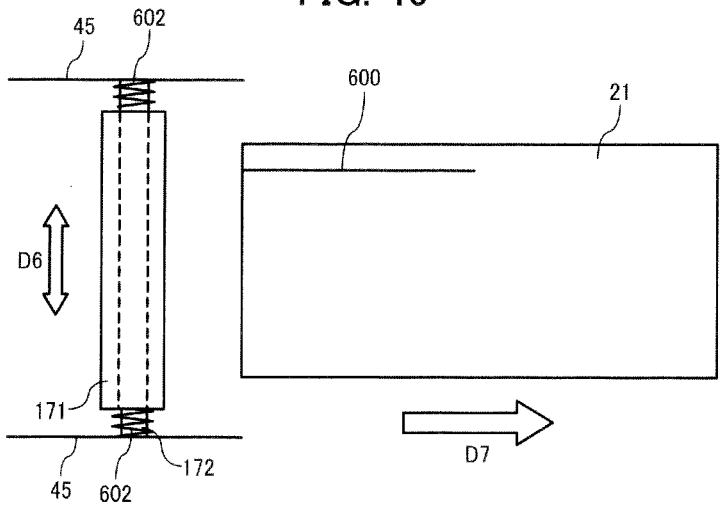
FIG. 46 is a partial front view of an image forming apparatus according to a fifteenth embodiment of this disclosure.

FIG. 46 is a partial front view of an image forming apparatus according to this embodiment.

For this embodiment, the image forming apparatus includes elastic members 602, each of which is disposed between an end of an auxiliary roller 171 and a holder member 45.

For such a configuration, even if the auxiliary roller 171 moves to correct misregistration of a printing medium 2, the auxiliary roller 171 can return to an original position when the printing medium 2 separates from the auxiliary roller 171. It is to be noted that the elastic member may be disposed at only one side.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a media roll in which a printing medium having an adhesive face is wound in a roll shape;

an image folining device to form an image on the printing medium; and a feeder to feed the printing medium, the feeder including:

a protection belt to press against and protect the adhesive face of the printing medium;

a pair of rotary bodies disposed opposing each other to sandwich and press the protection belt and the printing medium including the adhesive face between the pair of rotary bodies, wherein one rotary body in the pair of rotary bodies presses the combination of the printing medium and the protection belt against the other rotary body amongst the pair of rotary bodies; and an auxiliary rotary body disposed between the media roll and the pair of rotary bodies and configured to be movable to a position for defining an approach angle of the printing medium to be within a range from 0° to 30° when the printing medium includes the adhesive face is to be fed, and movable to another position for defining the approach angle to be greater than 30° when a medium that does not include an adhesive face is to be fed, the approach angle being formed by the printing medium drawn from the media roll and approaching to between the pair of rotary bodies and an opposing face of the protection belt opposing the image forming device.

2. The image forming apparatus according to claim 1, wherein the media roll is disposed below the pair of rotary bodies and, relative to the printing medium, the auxiliary rotary body is disposed at a side to support the adhesive face of the printing medium.

3. The image forming apparatus according to claim 1, wherein the media roll is disposed below the pair of rotary bodies and, the auxiliary rotary body is movable between a position at which the approach angle of the printing medium is within the range from 0° to 30° and a position at which the auxiliary rotary body decurls the printing medium.

4. The image forming apparatus according to claim 1, wherein the auxiliary rotary body is movable in an axial direction of the auxiliary rotary body.

5. The image forming apparatus according to claim 4, wherein the auxiliary rotary body is movable to a position higher than the protection belt.

6. The image forming apparatus according to claim 4, wherein the auxiliary rotary body includes a shaft portion and a pressing member to press the shaft portion.

7. The image forming apparatus according to claim 1, wherein the feeder feeds the printing medium in a conveyance direction, and the pair of rotary bodies are disposed upstream of the image forming device in the conveyance direction.

* * * * *